US008911134B2

(12) United States Patent
Hsu

(10) Patent No.: US 8,911,134 B2
(45) Date of Patent: Dec. 16, 2014

(54) EXIT SIGN ILLUMINATED BY COLOR LEDS

(75) Inventor: Georgiana Hsu, Bronx, NY (US)

(73) Assignee: DeNovo Lighting, LLC, Flushing, NY (US)

( * ) Notice: Subject to any disclaimer, the term of this patent is extended or adjusted under 35 U.S.C. 154(b) by 10 days.

(21) Appl. No.: 13/134,511

(22) Filed: Jun. 9, 2011

(65) Prior Publication Data

US 2011/0232143 A1 Sep. 29, 2011

Related U.S. Application Data

(63) Continuation-in-part of application No. 12/156,235, filed on May 30, 2008.

(60) Provisional application No. 60/932,281, filed on May 30, 2007.

(51) Int. Cl.

| | |
|---|---|
| ***F21V 7/04*** | (2006.01) |
| ***G09F 13/06*** | (2006.01) |
| ***G08B 7/06*** | (2006.01) |
| ***G09F 13/18*** | (2006.01) |
| ***G09F 13/22*** | (2006.01) |
| *G09F 13/04* | (2006.01) |

(52) U.S. Cl.

CPC ..... *G09F 13/06* (2013.01); *G08B 7/062* (2013.01); *G09F 13/18* (2013.01); *G09F 13/22* (2013.01); *G09F 2013/0459* (2013.01); *G09F 2013/1854* (2013.01); *G09F 2013/222* (2013.01)

USPC ..... 362/613; 40/570

(58) Field of Classification Search

USPC ..... 362/613; 40/570

See application file for complete search history.

(56) References Cited

U.S. PATENT DOCUMENTS

| | | | | |
|---|---|---|---|---|
| 5,446,440 | A * | 8/1995 | Gleason et al. | 340/331 |
| 5,659,283 | A * | 8/1997 | Arratia | 337/206 |
| 5,797,673 | A * | 8/1998 | Logan et al. | 362/234 |
| 5,897,194 | A * | 4/1999 | Ham | 362/20 |
| 6,471,388 | B1 * | 10/2002 | Marsh | 362/559 |
| 6,567,010 | B1 | 5/2003 | Lin et al. | |
| 7,114,840 | B2 | 10/2006 | Hamrick | |
| 2004/0170015 | A1 * | 9/2004 | Hamrick | 362/230 |

* cited by examiner

*Primary Examiner* — Mary Ellen Bowman
(74) *Attorney, Agent, or Firm* — Fox Rothschild LLP

(57) ABSTRACT

An exit sign comprising a housing, a plurality of green color LEDs and red color LEDs or bicolor green and red color LEDs positioned in the housing for emitting both a green color light and a red color light with a filter holder for holding a selected green color filter or a selected red color filter for passing the selected green color light or selected red color light to a stencil having openings for passing the selected green color light or selected red color light to an observer. Yellow color LEDs can be alternatively positioned in the housing for emitting yellow color light comprising both green color light and red color light. White color LEDs can also be alternatively positioned in the housing for emitting white color light also comprising both green color light and red color light.

22 Claims, 25 Drawing Sheets

EXIT SIGN ILLUMINATED BY COLOR LEDS

RELATED U.S. APPLICATION DATA

This patent application claims benefit of U.S. Provisional Application No. 60/932,281 filed on May 30, 2007 entitled, "Exit Sign illuminated by Color LEDs".

This patent application is a continuation-in-part of application Ser. No. 12/156,235 filed on May 30, 2008, which has been abandoned.

FIELD OF THE INVENTION

The present invention relates generally to color light emitting diode lamps used in illuminated emergency exit signs.

BACKGROUND OF THE INVENTION

Earlier exit signs used incandescent lamps. The earliest alternatives to incandescent lamps were radioactive tritium gas and compact fluorescent lamps. In 1985, light-emitting diodes (LEDs) were introduced for use in exit signs.

According to the National Fire Protection Association (NFPA), National Electrical Code (NEC), Underwriters Laboratories (UL), and local fire and building codes for each state, buildings that provide public access are required by law to have signs identifying the exits. These emergency signs are required to exhibit a specific amount of illumination and often times are required to have an emergency backup power source to provide illumination for a specified period of time when electrical power to the building is interrupted to allow sufficient time for persons in the building to vacate. LED exit signs are presently available with red or green color LEDs or other colors, as required by local ordinances or municipalities and depending on state and city codes.

The different red or green color output LED exit signs as required by local ordinances or municipalities, and adhering to state and city codes present a problem with the LED exit sign distributor. Often times, the wrong color LED exit sign is delivered and when this is the case, the original color LED exit sign is returned to the distributor and a replacement color LED exit sign is then shipped out again. With this frequent occurrence, the shipping costs can add up rather quickly. Having only one LED exit sign that can offer either red or green color is most desirable. The present invention will allow for this to occur without the use or additional cost for color selective switches. The final color output of the LED exit sign is determined by the color filter used with the integral color LEDs. Both red and green color filters will be supplied with each color LED exit sign using the color LED lamp of the present invention.

The LED lamp of the present invention turns on both the red and green color output LEDs simultaneously to produce a yellow color light. The combined yellow color light from the LEDs are then passed through either a red color filter to produce a red color exit sign indicia, or through a green color filter to produce a green color exit sign indicia.

The color LED exit sign works by filtering the LED light output from the color LED lamp to output the desired red or green indicia. Red and green are complementary colors that when additively mixed together, will produce the color yellow. Now when this color yellow is used with a red color filter, the red color filter absorbs the green LED colors and transmits the red LED colors, thereby producing only red color indicia for the exit sign. Likewise, when the same color yellow is used with a green color filter, the green color filter will absorb the red LED colors and will transmit only the green LED colors, thereby producing only green color indicia for the exit sign. It should be noted that the wavelengths of the red or green color filters should match closely with the wavelengths of the red or green color LEDs for the best and brightest color light absorption and transmission.

Exit signs usually include a stencil having perforations that define indicia through which the LED light passes and is readable by an observer. Existing stencil signs have solid colored green or red diffusion panels behind opaque sections with the letters EXIT cut out. Other exit signs can include a stencil manufactured out of a clear lens with the indicia or background masked with a red, green, or other color ink. The word EMT is usually white in this case against the color background. The indicia generally form the letters of the word EXIT and include removable or permanent chevron arrows located on opposite sides of the word EXIT. Other words, symbols, or ideogram indicia can indicate an exit. Among these are words or symbols in non-English speaking countries that have an analogous meaning to the word EXIT in English.

The present invention provides an LED lamp that enables a user to produce distinct color outputs. The color LED lamp is designed for use in illuminated signs generally including emergency exit signs, but also other types of illuminated signs that can be used in different locations. The use of the color LED lamp will allow the emergency signage to comply with all local fire and building code requirements. An LED exit sign manufacturer, wholesaler, and retailer can stock only one basic version of the color LED lamp exit sign thereby reducing manufacturing, inventory, and shipping costs. The color LED lamp is designed to replace existing incandescent and single color LED lamps. It can be used directly in sockets of existing emergency exit signs as retrofit LED lamps, or as the main light source in new emergency exit signs and other illuminated signs. Besides using the color LED lamp of the present invention in emergency exit signs, the color LED lamp can be used in illuminated advisory, directional, instructional, warning, and safety demarcation signs. Another area where the color LED lamp of the present invention can be used is in warning and instructional lighting markers used in many truck-loading docks around the country.

It is an object of the present invention to provide a color LED lamp, wherein one of the color red or the color green can be used for emergency lighting applications incorporating light emitting diodes as the main light source for use in existing and newly manufactured signage lighting fixtures.

Another object of the present invention is to provide a color LED lamp that can readily replace the incandescent and compact fluorescent lighting units offering energy efficiency, longer life with zero mercury, zero disposal costs, and zero hazardous waste. The present invention can be used in all types of emergency and illuminated signage.

Yet another object of the present invention is to provide a color LED lamp that will easily produce a mixed red and green color to produce the color yellow while using a relatively low number of colored LEDs, and wherein such use is in the field of emergency exit signs.

Yet another object of the present invention is to provide a color LED lamp that will easily produce monochrome yellow color light while using a relatively low number of colored LEDs, and wherein such use is in the field of emergency exit signs.

Yet another object of the present invention is to provide a color LED lamp that will easily produce white color light while using a relatively low number of white color output LEDs, and wherein such use is in the field of emergency exit signs.

A further object of the present invention is to provide a color LED retrofit lamp containing integral electronic circuitry that can be readily and economically fabricated from simple electronic components for easy adaptation for use with existing illuminated signage.

And yet a further object of the present invention is to provide a color LED lamp combined with surge suppression, uniform illumination, color filters, optical diffusers, battery backup, and low power consumption to be readily and economically fabricated from simple components, for use in newly manufactured and multipurpose illuminated emergency signage that is readily adaptable to comply with fire and building code.

A final object of the present invention is to provide a color LED lamp for use in newly manufactured illuminated signage with optional emergency lights integrally and operationally mounted with the main lamp unit.

BRIEF SUMMARY OF THE INVENTION

The color LED lamp comprises an array of red color output LEDs and an array of green color output LEDs, each LED in each array is connected in a series and parallel relationship with similar color output LEDs. Alternating current AC input voltage is converted to direct current DC voltage by bridge rectifiers to power the LEDs. Both arrays of red and green color output LEDs are turned on to emit light at the same time resulting in the production of the color yellow. The additive mixed color yellow light is then passed through either a red color filter to show red indicia, or through a green color filter to show green indicia.

Besides additively mixing both red and green LED colors to create the color yellow, other colors and types of LEDs when used with either a red color filter or a green color filter will produce similar end results for the color LED lamp used in this color LED exit sign. They include using bi-color red and green LEDs, using broadband monochrome yellow color output LEDs, and lastly using white color output LEDs in the color LED lamp of the present invention. Warm white color output LEDs with lower Kelvin color temperatures contain some red colors in their light emissions and will produce better red color indicia when filtered, while bluish white color output LEDs with higher Kelvin color temperatures contain more green colors in their light emissions to produce better green color indicia when filtered. A proper white color output LED has to be used that will have the majority of both red and green light emissions to produce the best red and green color indicia when filtered. A combination of mixed warm white and high bright white color output LEDs may be used or a combination of white LEDs with yellow and amber monochrome LEDs may also be used.

The plurality of LEDs is mounted onto a rigid circuit board with or without an external housing. The AC power to the color LED lamp can terminate in any standard lamp base configuration including, but not limited to bi-pin, medium screw, candelabra, pin connectors, etc. This color LED lamp can be used in single and double panel mount exit signs, edge mount exit signs, stencil exit signs, panel mount exit signs fitted with emergency lights, and other illuminated signage. The color LED lamp can also work with direct DC input power.

The color LED lamp of the present invention can be used in newly manufactured illuminating signage as well. This color LED lamp in combination with a number of other components including a step-down transformer to convert 120/220/277 VAC to a lower voltage to power the LEDs, and to serve as a voltage suppresser; a battery backup system with testing capability that is charged by the AC power input; a fixture housing or body; a fixture mount; background stencil and lettering or symbol indicia; at least one optical diffuser; at least one red and at least one green color filter, and optional integral emergency lights all combine to form a color LED illuminating emergency sign of the present invention.

U.S. Pat. No. 6,567,010 issued to Lin and Zhu on May 20, 2003, discloses a traffic signal head with individual activation of 1) red light LED generating elements and green light LED generating elements, and 2) red light LED generating elements and green light LED generating elements with simultaneous activation of the red and green light LED generating elements producing yellow light. The two main claims in Lin set forth the combination of the individual activations of red, green, and yellow light, a housing, activation circuitry, and the inventive feature of circuitry for enabling adjustment of the relative intensity of the yellow light produced by the activation of the red and green light.

However, Lin et al. does not disclose, as does the present invention a combination of elements that includes means for passing both red light and green light from an array of red LEDs and an array of green LEDs in the form of indicia symbolizing an exit and enabling the viewing by an observer. Nor does Lin disclose means for optically filtering and/or diffusing the red light or green light or yellow light positioned in the housing between the array of red LEDs and the array of green LEDs positioned in the housing, and the means for passing light in the form of indicia. The present invention includes only yellow light produced by the simultaneous production of both red and green light that passes through the indicia symbolizing an exit. There is no adjustment of the relative intensity of the yellow light. There is no selective activation of individual red or green LED arrays. The red light and green light is full on resulting in a yellow light that is full on at all times.

U.S. Pat. No. 7,114,840 issued to Hamrick on Oct. 3, 2006, discloses primarily an exit sign illuminated by either red color, green color, or yellow color outputs with the use of an electromechanical switch to selectively turn on either red LED arrays, or green LED arrays, or both red and green LED arrays to produce the red color, green color, or yellow color outputs respectively, in the form of indicia symbolizing an exit and enabling the viewing by an observer. Hamrick further discloses means for optically filtering and diffusing the red light or green light positioned in the housing between the array of red LEDs and the array of green LEDs positioned in the housing, and lastly a stencil for passing light in the form of indicia. The present invention is different and includes only yellow light produced by the simultaneous production of red and green light that passes through the stencil and indicia symbolizing an exit without the added cost of an electromechanical color selective switch. No activation of individual red LEDs or individual green LEDs are present, both red LEDs and green LEDs are activated at the same time to produce the additive mixed color yellow light that is then passed through either a red color filter to produce a red output or through a green color filter to produce a green output in the form of indicia symbolizing an exit and enabling the viewing by an observer. In addition, there is no use of an electromechanical color selective switch; therefore the LEDs in the present invention are always energized when power is present.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention, and what is presently considered and believed to be the best mode of practice in the principles thereof.

DETAILED DESCRIPTION OF THE INVENTION

Figure 1:
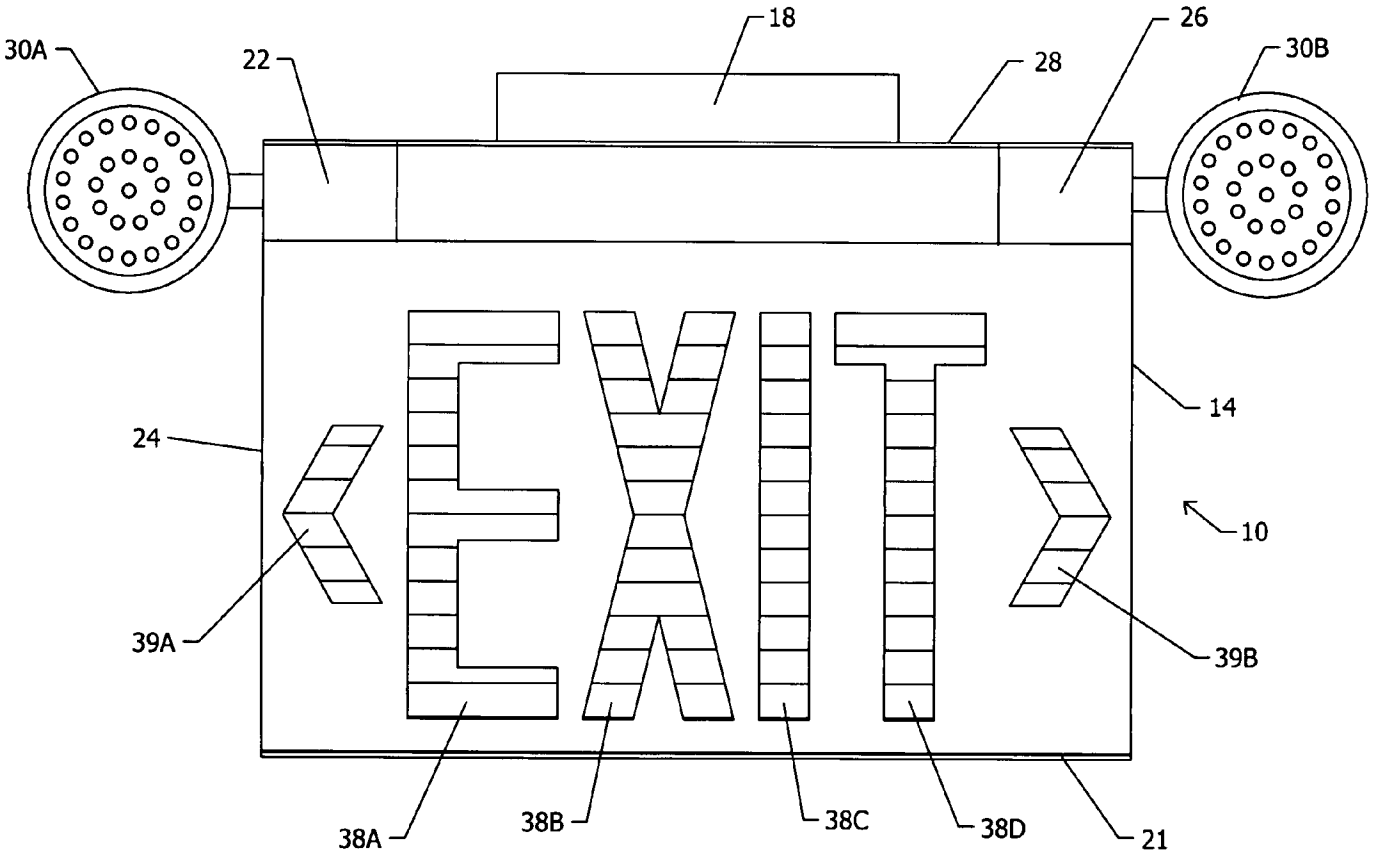
FIG. 1 shows a front view of an assembled color LED exit sign in accordance with the present invention.

Reference is now made to the drawings and in particular to FIGS. 1-8 in which identical or similar parts are designated by the same or similar reference numerals throughout.

A color light emitting diode (LED) sign 10 is shown in FIGS. 1-8 and in particular in assembled front view in FIG. 1. Sign 10 includes disassembled elements shown in FIGS. 1A, 1B, 1C, 1D, and 1E.

Figure 1A:
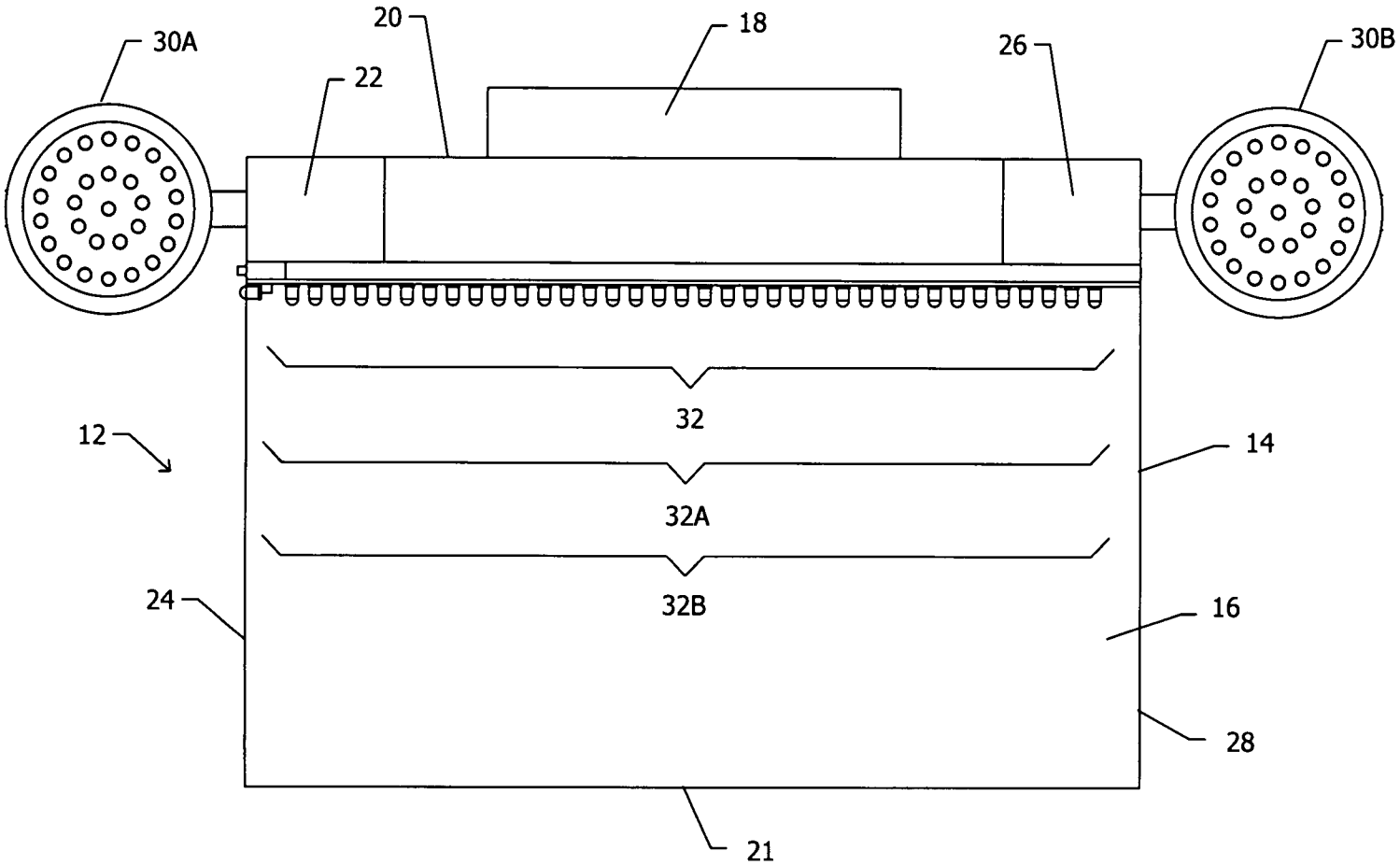
FIG. 1A shows the basic mount structure for the color LED exit shown in FIG. 1 along with two attached emergency lights along with LED lamps mounted thereto.

In particular, FIG. 1A shows a disassembled front view 12 of sign 10 comprising a housing 14 and a flat rear panel 16 mounted thereto. A canopy 18 attached to the top edge 20 of housing 14 provides support for hanging the entire sign 10 to a ceiling structure (not shown). A step-down transformer 22 is mounted at top edge 20 at one side edge 24 of housing 14 opposite bottom edge 21 and a rechargeable backup battery 26 is mounted at top edge 20 at the opposed side edge 28 of housing 14. Optional emergency lights 30A and 30B are attached to housing side edges 24 and 28 respectively. An array of thirty-six monochrome color LEDs 32 is horizontally mounted in a manner known in the art at equal intervals across the area of top edge 20 of flat rear panel 16 between side edges 24 and 28.

Figure 1B:
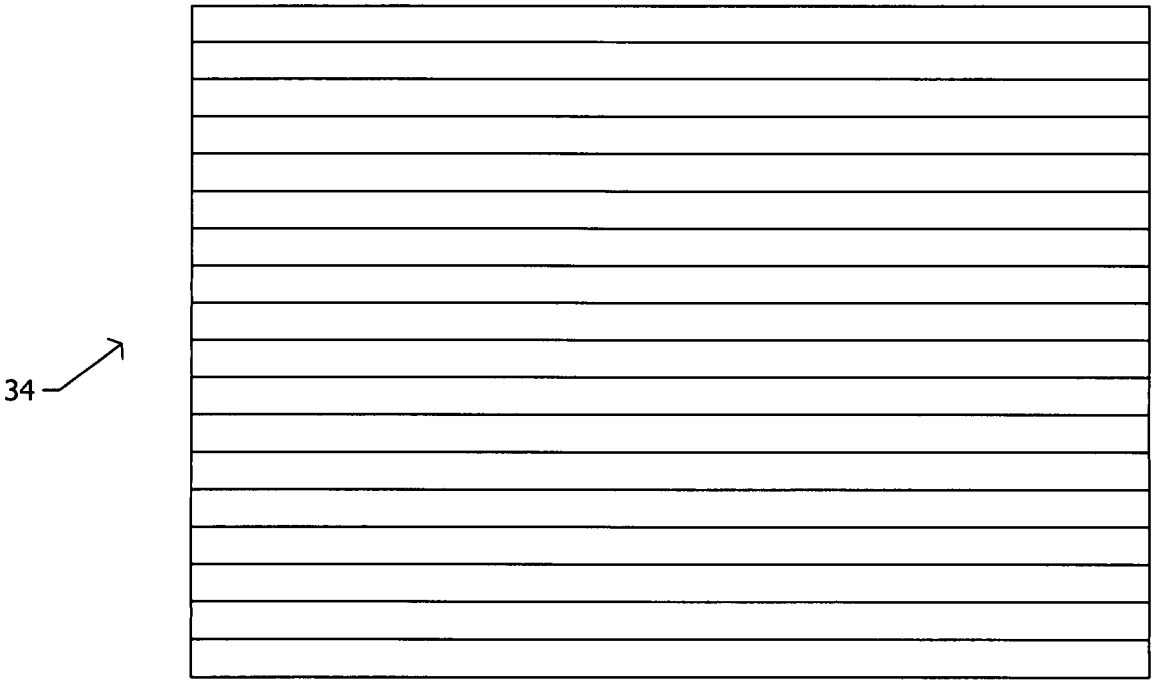
FIG. 1B shows an optical diffuser of the color LED exit sign shown in FIG. 1 before being mounted to the mount structure shown in FIG. 1A.

FIG. 1B shows in isolation the front view of an optical diffuser 34 known in the art that is secured to housing 14 and positioned over LEDs 32.

Figure 1C:
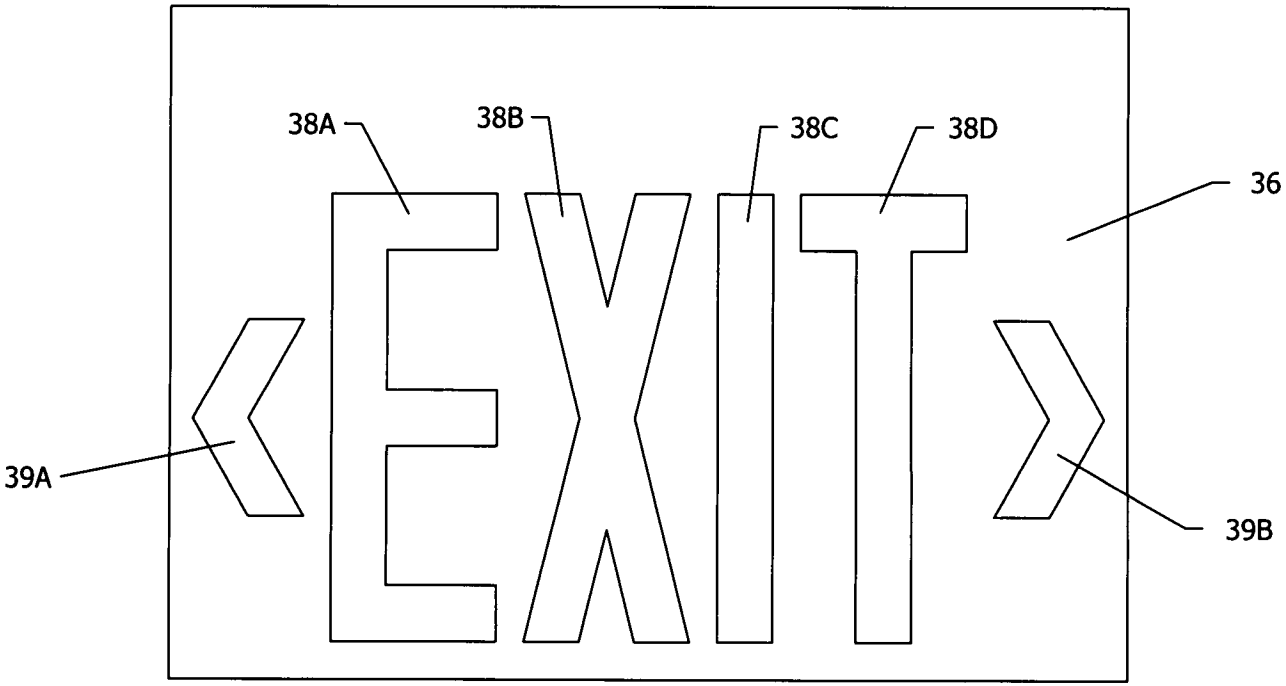
FIG. 1C shows the front face of a stencil defining indicia indicating an exit that is mounted to the mount structure shown in FIG. 1A over the optical diffuser shown in FIG. 1B of the color LED exit sign shown in FIG. 1.

FIG. 1C shows a rectangular stencil 36 in front view taken in isolation that is secured to housing 14 in assembled mode and positioned over optical diffuser 34, LEDs 32, and rear panel 16. Stencil 36 is also shown in FIG. 1. Stencil 36 is generally non-transparent and includes four light passageway openings 38A, 38B, 38C and 38D that define the four letters, or four indicia, in capitalized mode of the word EXIT, respectively, that extend horizontally in the mid area of stencil 36 through which light beams projected by LEDs 32 pass through each light passageway opening 38A, 38B, 38C and 38D after passing through optical diffuser 34 for eventual viewing by an observer. Stencil 36 optionally defines two directional symbols, namely, opposed chevron arrow openings 39A and 39B through which light beams projected by LEDs 32 pass for eventual viewing by an observer.

Figure 1D:
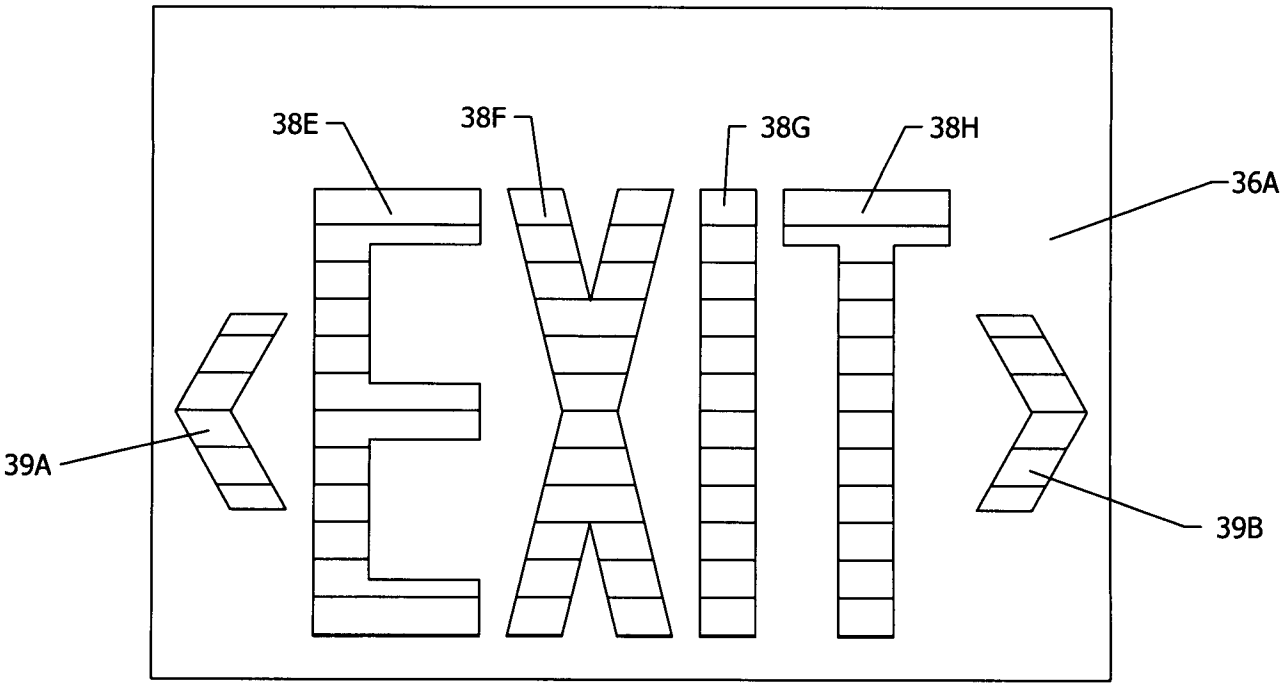
FIG. 1D shows the front face of an alternative stencil.

FIG. 1D shows an alternative embodiment of the rectangular stencil 36, namely stencil 36A in front view taken in isolation that is secured to housing 14 in assembled mode and positioned over optical diffuser 34, LEDs 32, and rear panel 16. Stencil 36A is clear and translucent, but is made non-translucent by a manner known in the art such as by the application of paint or other masking medium. Stencil 36A provides four transparent areas 38E, 38F, 38G, and 38H that define the four letters or four indicia, in capitalized text mode of the word EXIT, respectively, and that extend horizontally in the general mid area of stencil 36A through which light beams projected by LEDs 32 pass through each transparent area 38E, 38F, 38G, and 38H after passing through optical diffuser 34 for eventual viewing by an observer. Stencil 36A optionally includes other transparent areas such as two directional symbols, namely, opposed chevron arrows 39A and 39B through which light beams projected by LEDs 32 pass for eventual viewing by an observer. Other variations of stencils 36 and 36A are possible within the parameters of the present invention. It should be noted that the alternative stencil 36A itself could be manufactured out of a diffusion material thereby further reducing parts by eliminating the need for a separate optical diffuser 34.

Figure 1E:
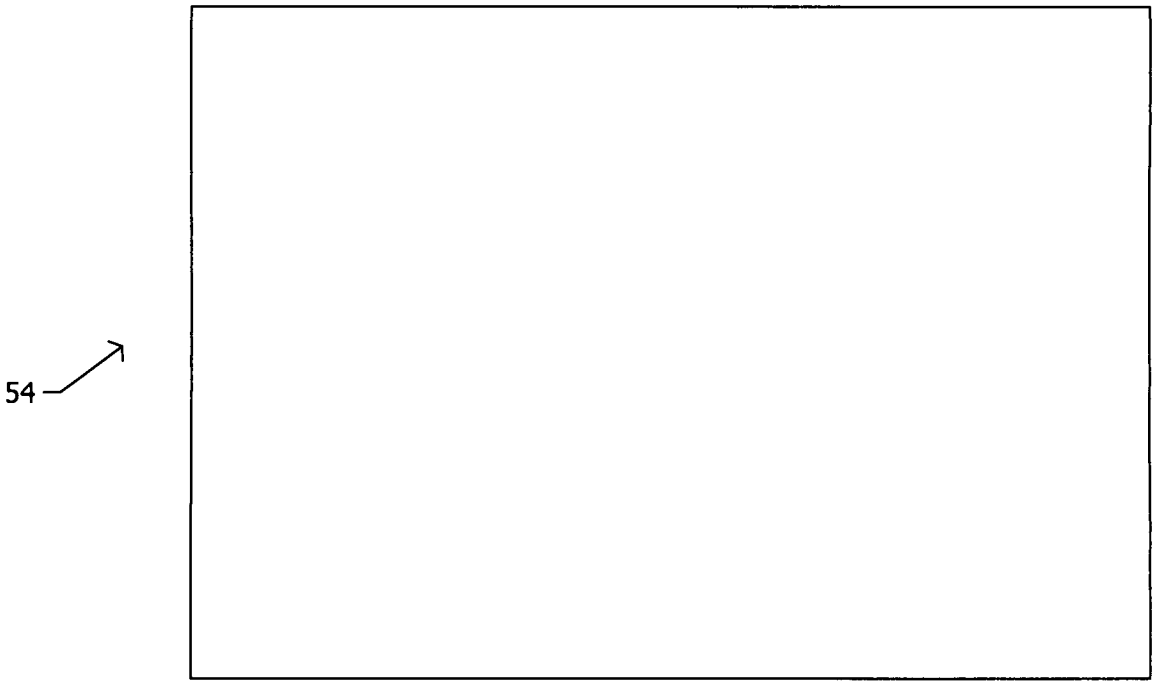
FIG. 1E shows the front face of a color filter.

FIG. 1E shows in isolation the front view of a color filter 54 that is secured to housing 14 and positioned over LEDs 32 between stencil 36 or stencil 36A, and juxtaposed to optical diffuser 34. It is possible to combine the optical diffuser 34 with color filter 54 into the same single lens thereby reducing parts and component cost. Color filter 54 can be a red color filter with a wavelength in the range approximately from 630 to 760 nm, or color filter 54 can be a green color filter with a wavelength in the range approximately from 500 to 515 nm.

Figure 2:
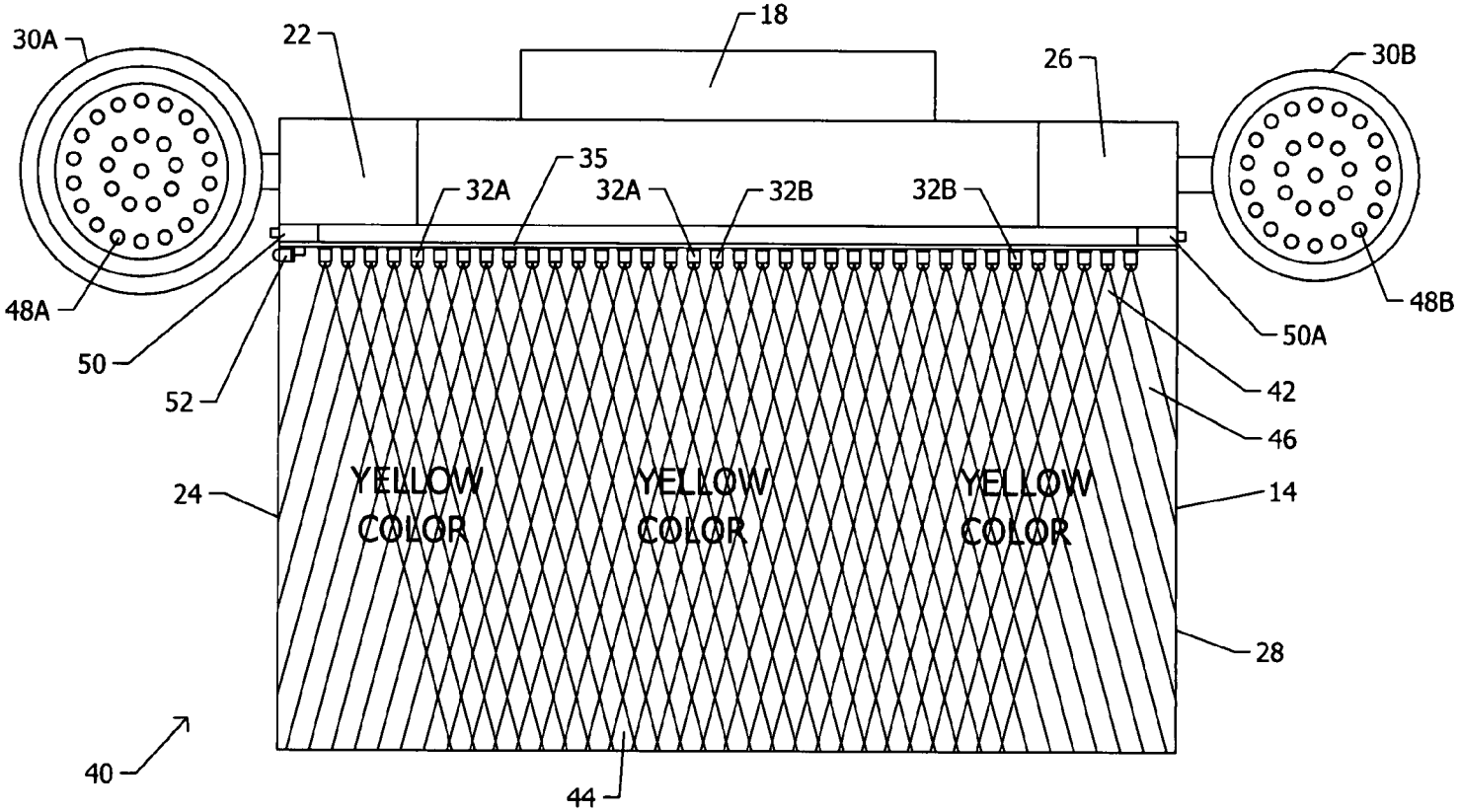
FIG. 2 shows the color LED exit sign as shown in FIG. 1 in a simplified form showing additively mixed yellow color output LED light beams from the combination of the red LED light beams with the green LED light beams.

FIG. 2 shows a more detailed view 40 of the disassembled front view 12 shown in FIG. 1A and wherein thirty-six monochrome color LEDs 32 include for purposes of exposition twelve red LEDs 32A and twenty-four green LEDs 32B each individually mounted to and electrically connected to a circuit board 35 that is attached to housing 14. The relative numbers of LEDs 32A and 32B can vary. For example, equal numbers of red LEDs 32A and green LEDs 32B can be used. As shown in FIG. 2, the arrangement of thirty-six LEDs 32 are such that there are two green LEDs 36B located between every red LED 36A with a green LED 36B positioned at each end of the total array of thirty-six LEDS 32. The actual number of red color LEDs 32A and green color LEDs 36B can vary depending on the make and type of LED 32 used as determined by the output beam angle and the output lumen generated by each LED 32. Red color beams 42 are produced from red LEDs 32A and green color beams 46 are produced from green LEDs 32B. Yellow color beams 44 are produced from a combination mixing of the red color beams 42 emitted from red LEDs 32A added to the green color beams 46 emitted from green LEDs 32B. Red color beams 42 represents all red color beams, green color beams 46 represents all green color beams, and yellow color beams 44 represents all yellow color beams.

Also seen in FIG. 2 are twenty-eight monochrome LEDs 48A positioned in a concentric circular arrangement in optional emergency light 30A mounted to side edge 24 of housing 14, and twenty-eight monochrome LEDs 48B positioned in a concentric circular arrangement in optional emergency light 30B mounted to side edge 28 of housing 14. A normally closed DC disconnect test switch 50 is positioned on circuit board 35 proximate to LEDs 32 to test the battery backup system, and a DC power status LED 52 is also positioned on circuit board 35. A normally open DC connect test switch 50A is also positioned on circuit board 35, which when closed will connect power to LEDs 48A and 48B in emergency lights 30A and 30B respectively.

Figure 3:
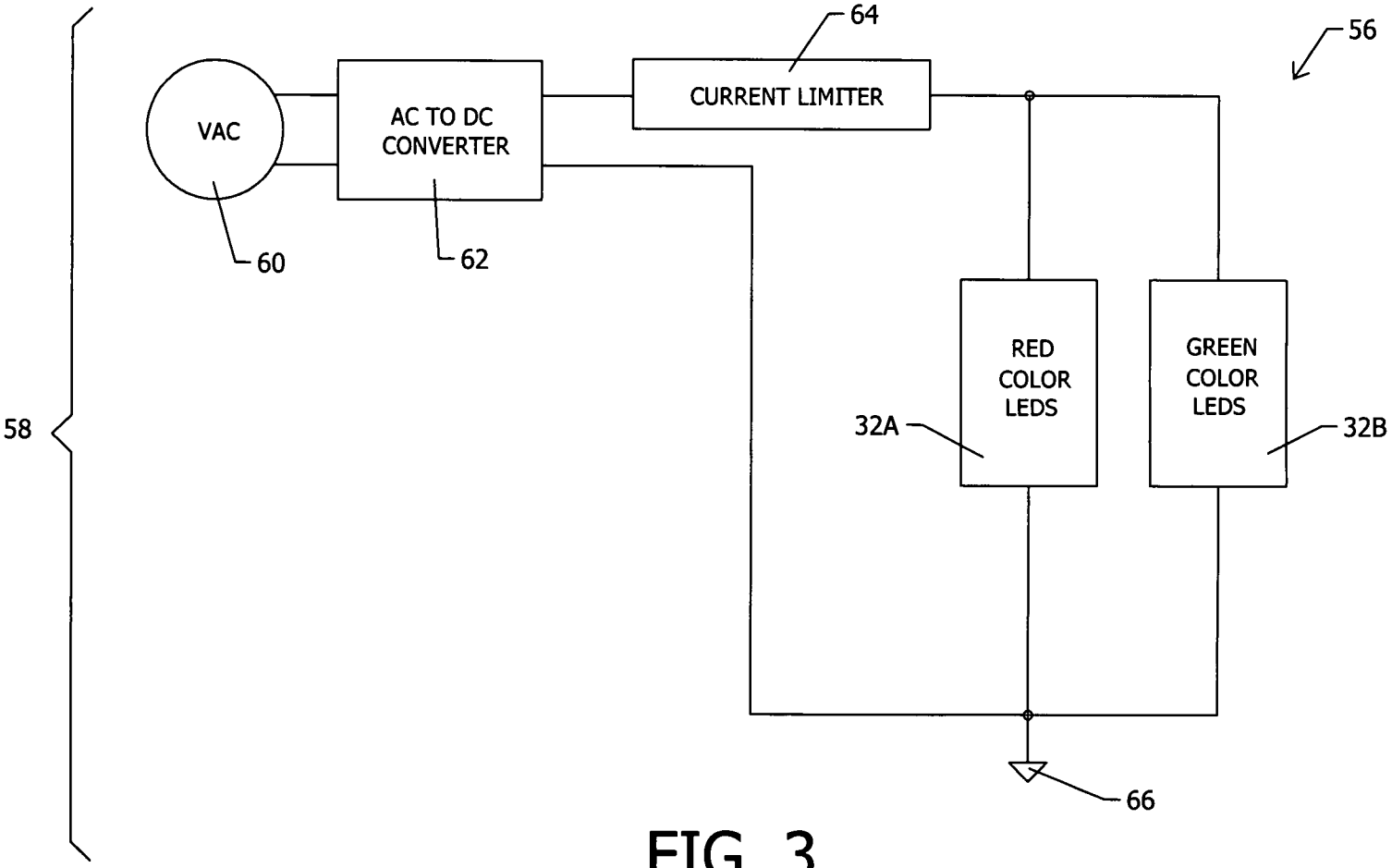
FIG. 3 shows an isolated schematic block diagram of the isolated color LED lamp of the color LED exit sign shown in FIGS. 1 and 2.

FIG. 3 shows a schematic block diagram 56 of a color LED lamp 58 taken in isolation. Color LED lamp 58 can be used in retrofit applications for existing illuminated signs or as the main color LED lamp in new fixtures. LED lamp 58 basically comprises an alternating current voltage (VAC) power input 60 that is readily converted into a DC voltage output to power red and green color LEDs 32A and 32B, respectively, by an AC to DC converter 62.

A single main or individual current limiter, or resistor 64, is used to limit the current going into red LEDs 32A and green LEDs 32B. Red LEDs 32A and green LEDs 32B comprise of LEDs 32 connected in both a series and a parallel configuration for redundancy. This is done, so that the majority of red LEDs 32A and green LEDs 32B will remain energized in the event that one or more LEDs 32 in each array should fail.

Each of the red LEDs 32A and green LEDs 32B are in direct communication with the power supply circuit that energizes all the red LEDs 32A and green LEDs 32B. Red LEDs 32A are energized at the same time with green LEDs 32B. When both red LEDs 32A and green LEDs 32B are energized, a third color, namely the color yellow, will appear resulting from the combination of the additive mixing of the output color beams from red LEDs 32A with green LEDs 32B. LEDs 32 are connected to ground 66, thereby completing the current path through red LEDs 32A and green LEDs 32B respectively. This third additively mixed color yellow light then passes through either a red color filter to show red color indicia, or through a green color filter to show green color indicia.

Figure 4:
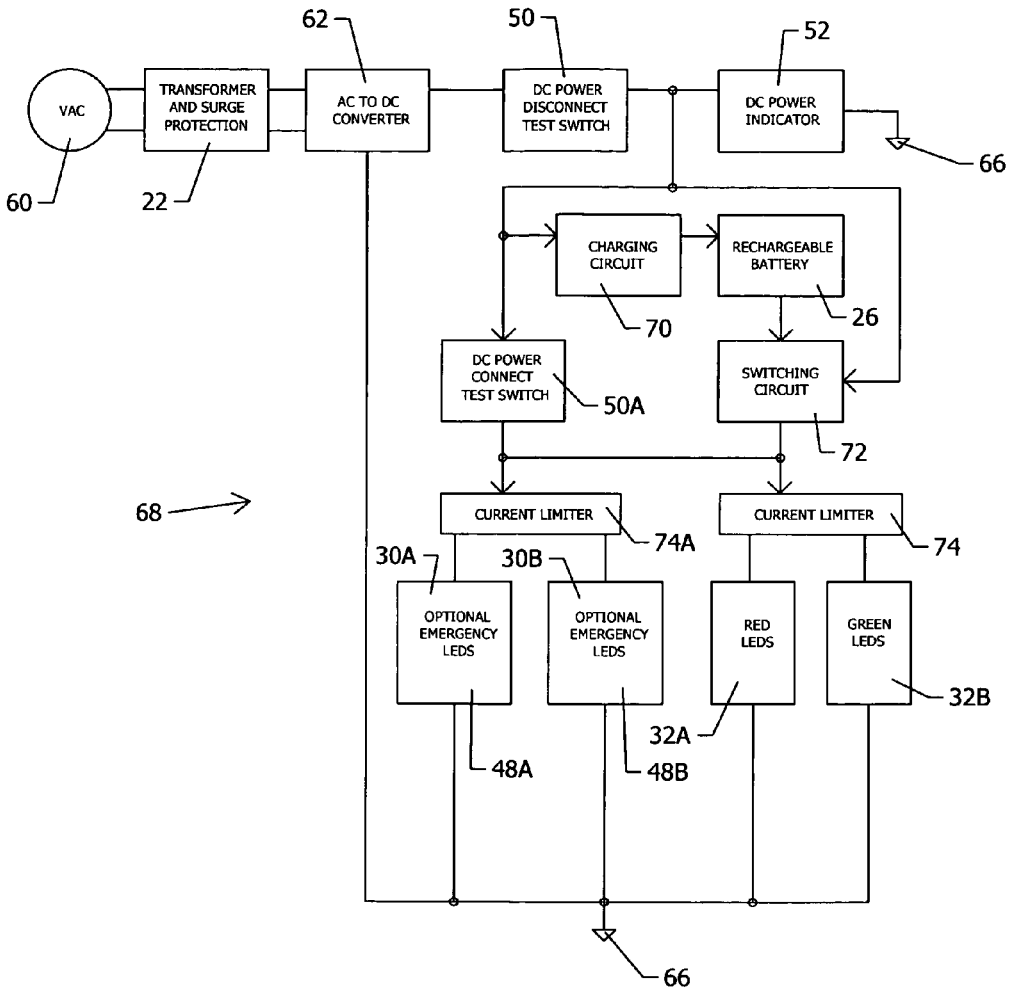
FIG. 4 shows a complete schematic block diagram of the color LED exit sign shown in FIGS. 1 and 2 including the color LED lamp shown in FIG. 3.

FIG. 4 shows a schematic block diagram 68 of exit sign 10. The usual source of power to an emergency exit sign is alternating current voltage or VAC 60. This voltage can be 120V, 240V, or 277V. Since the input AC voltage is high, a step-down transformer typified by step-down transformer 22 also shown in FIG. 2 is used to bring the input voltage down to a lower operating AC voltage, for example ~VAC. The ~VAC is then passed through AC/DC converter 62 typically a bridge rectifier. A second transformer (not shown) can be used to serve as a redundant power source in the event the first step-down transformer 22 stops working, and vice versa.

The direct current voltage or VDC is then connected to a momentary DC power disconnect test switch 50 that is normally closed. The function of DC power disconnect test switch 50 is to test the electronic circuitry of the backup system to battery 26 by simulating the interruption of DC voltage power. DC power indicator LED 52 signals the presence of AC voltage power.

The DC voltage also goes through a charging circuit 70 connected to rechargeable battery 26 and then to a switching circuit 72. The output of switching circuit 72 then goes through a main or individual current limiter 74, and lastly to red LEDs 32A and green LEDs 32B. The function of switching circuit 72 is to provide power to red LEDs 32A and green LEDs 326 when normal input DC voltage is present, but will automatically switch over to battery backup 26 DC power in the event of input AC power failure. Today, smart electronics and computer data programs (not shown) can be included in the electronics of the color LED lamp of the present invention to test the functionality of the color exit sign and to cycle battery backup 26 to make sure everything is operating correctly.

Two separate monochrome LED lights 30A and 30B, respectively, act as optional emergency lights. The LEDs 48A and 48B for use in emergency LED lights 30A and 30B are monochrome comprising either white and/or yellow color LEDs. They are optional and serve as emergency lighting for the egress and evacuation of buildings or other establishments in the event of power failure and general lighting is not available. A separate DC power connect test switch 50A energizes the optional emergency monochrome LEDs 48A and 48B. The output of switching circuit 72 also goes through current limiter 74A and then to monochrome LEDs 48A and 48B.

Momentary DC power status connect switch 50A is normally open and when depressed will connect the DC voltage power directly to test optional emergency lights 30A and 30B. In the absence of AC voltage power or when the DC power disconnect test switch 50 is depressed, backup battery 26 voltage power will kick in to power both red LEDs 32A and green LEDs 32B as well as providing power for LEDs 48A and 48B in optional emergency lights 30A and 30B. The storage capacity of backup battery 26 should provide enough reserve voltage to power all the LEDs in exit sign 10, including optional emergency lights 30A and 30B for a duration of 1.5 to 3.0 hours when there is no AC input voltage. Red LEDs 32A and green LEDs 32B and LEDs 48A and 48B in emergency LED lights 30A and 30B are connected to ground 66 thereby completing the current paths through red LEDs 32A and green LEDs 32B and LEDs 48A and 48B in emergency LED lights 30A and 30B.

Figure 5:
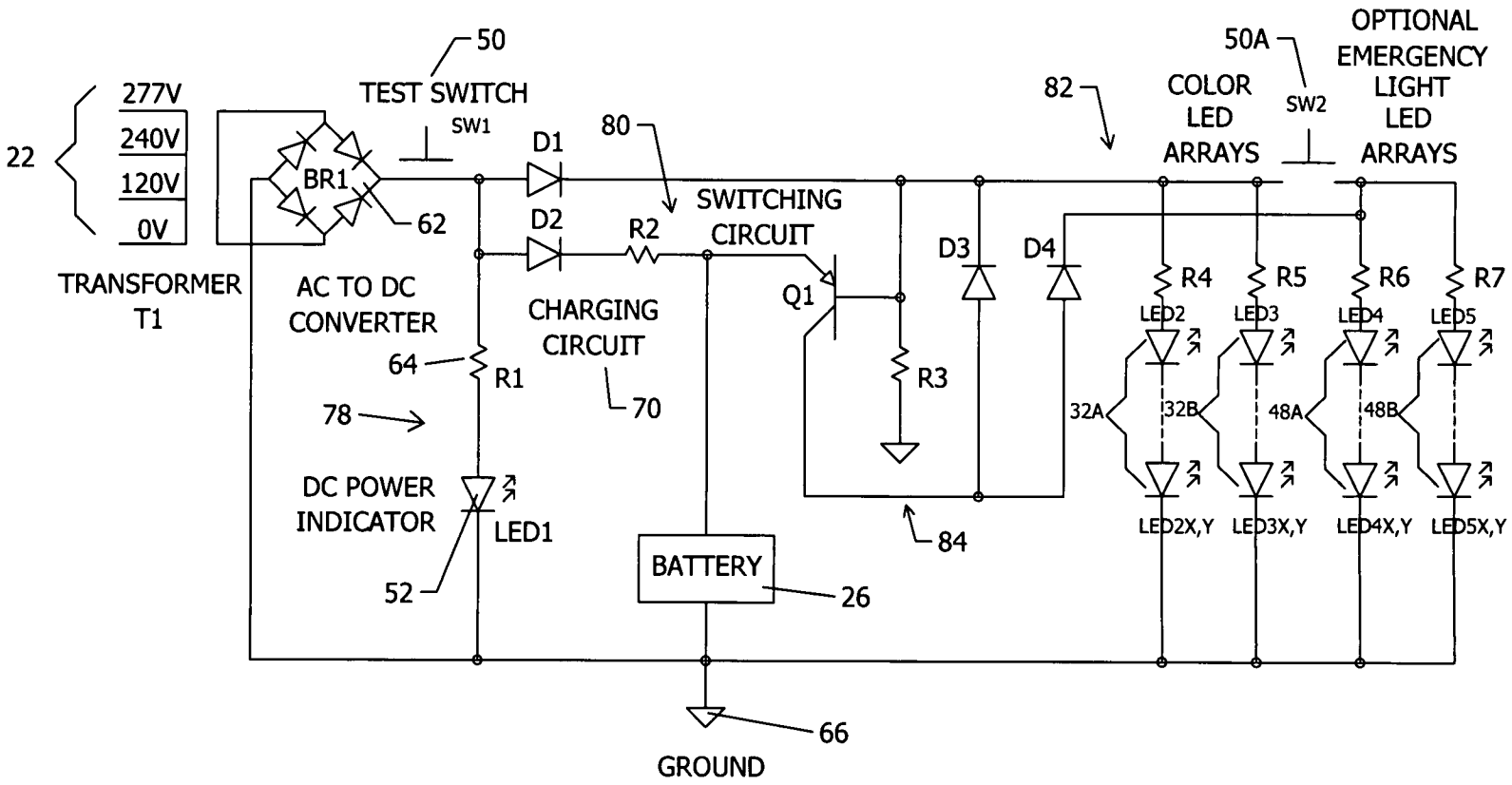
FIG. 5 shows the complete electrical circuit used for the color LED exit sign.

FIG. 5 depicts the electrical circuit used for color LED exit sign 10. Step-down transformer 22 shown here as TI has multiple primary input voltage taps depending on the voltage available. As mentioned before, these may be 120 volts, 240 volts, or 277 volts AC. The secondary output voltage of transformer 22 is the same at about 8 volts AC, also as mentioned before. The 8 volts AC are attached to the AC inputs of AC/DC converter 62 shown here as a bridge rectifier BR1. The negative output of bridge rectifier BR1 becomes the DC ground 66, while the positive output of bridge rectifier BR1 serves to deliver power to four main circuits by way of the normally closed momentary test switch 50 shown here as SW1.

A first circuit 78 passes DC voltage through current limiter 64, shown here as resistor R1, that limits current to DC power indicator LED 52, also indicated as LED1. One end of resistor R1 is connected to the anode of power indicator LED 52, and the cathode of power indicator LED 52 (LED1) is connected to DC ground 66. DC power indicator LED 52 lights up when AC input voltage is present and test switch 50 (SW1) is not depressed. Due to the fact that power indicator LED 52 (LED1) is by nature a diode itself, it prevents reverse current flow from DC ground 66 back to the positive DC output of bridge rectifier BR1. Therefore current flows only in one direction from the anode of DC power indicator LED 52 (LED1) to the cathode of DC power indicator LED 52 (LED1).

A second circuit 80 represents the charging circuitry 70 for delivering power to rechargeable battery 26 (BATTERY) for backup power in case of AC input voltage failure. DC voltage passes through diode D2 into resistor R2 and directly into the positive terminal of battery 26 (BATTERY). The negative terminal of battery 26 (BATTERY) is connected to DC ground 66. Diode D2 prevents the reverse current flow from battery 26 (BATTERY) back to the positive DC output of bridge rectifier BR1, and therefore allows current to flow only in one direction from the anode of diode D2 to the cathode of diode D2.

Third circuit 82 includes a complete array of red LEDS 32A as shown in FIG. 5 comprising individual red LEDs, namely, LED2 to LED2X,Y connected in an electrical series and parallel configuration for redundancy. Third circuit 82 also includes a complete array of green LEDs 32B as shown in FIG. 5 comprising individual green LEDS, namely, LED3 to LED3X,Y also connected in an electrical series and parallel configuration. This identification of red and green LEDs sets forth that red LEDs 32A and green LEDs 32B can each comprise of at least one red LED and at least one green LED connected in an electrical serial and parallel configuration.

In addition, third circuit 82 includes monochrome LEDs 48A and 48B. LEDs 48A is shown in FIG. 5 as comprising of individual monochrome LEDs, namely, LED4 to LED4X,Y, and LEDs 48B is shown in FIG. 5 as comprising of individual monochrome LEDs, namely, LED5 to LED5X,Y. This identification of individual monochrome LEDs sets forth that LEDs 48A and 48B can each comprise of at least one monochrome LED in an electrical serial and parallel configuration.

The actual number of red LEDs 32A and green LEDs 32B and monochrome LEDs 48A and 48B in optional emergency lights 30A and 30B can be the same number or can differ in number.

Third circuit 82 drives red LEDs 32A, namely, LED2 to LED2X,Y and green LEDs 32B, namely, LED3 to LED3X,Y during normal operation when input AC voltage is present and test switch 50 (SW1) is not depressed. DC voltage passes through diode D1 from the anode side to the cathode side. Diode D1 prevents the reverse current flow from LEDs 32A and 32B back to the positive DC output of bridge rectifier BR1, and therefore allows current to flow only in one direction from the anode of diode D1 to the cathode of diode D1. DC voltage passes to red LEDs LED2 to LED2X,Y by way of resistor R4. Likewise DC voltage passes to green LEDs LED3 to LED3X,Y by way of resistor R5. Resistors R4 and R5 provide current limiting to the individual red LEDs 32A and green LEDs 32B respectively. Red and green LEDs LED2 to LED2X,Y and LED3 to LED3X,Y each have at least one color LED connected in a series and parallel configuration for redundancy. The cathode of the last LED2X,Y of the red LEDs 32A is connected to DC ground 66. Likewise, the cathode of the last LED3X,Y of green LEDs 32B is also connected to DC ground 66. This completes the respective circuit and will energize all the corresponding red LEDs 32A and green LEDs 32B LED arrays simultaneously.

Normally open momentary power connect test switch 50A (SW2) is provided to test and turn on optional emergency LED lights 30A and 30B by providing temporary DC voltage power from the positive output of bridge rectifier BR1. The DC voltage passes to LEDs 48A, namely, LED4 to LED4X,Y by way of resistor R6. Likewise DC voltage passes to LEDs 48B, namely, LED5 to LED5X,Y by way of resistor R7. Resistors R6 and R7 provide current limiting to the individual LEDs 48A and 48B in optional emergency LED lights 30A and 30B. LEDs LED4 to LED4X,Y and LED5 to LED5X,Y each comprise of at least one LED connected in a series and parallel configuration for redundancy. The cathodes of LED 4X,Y and LED5X,Y are each connected to DC ground 66.

A fourth circuit 84 provides the automatic switching of DC voltage power to LEDs 32A, 32B, 48A, and 48B in the event of AC power failure. The positive terminal of battery 26 is connected to the emitter of PNP transistor Q1. The collector of transistor Q1 is connected to the inputs of red and green LED arrays 32A and 32B by way of diode D3, and also to the inputs of monochrome LEDs 48A and 48B in optional emergency lights 30A and 30B by way of diode D4. Diodes D3 and D4 prevent the reverse current flow from the individual diode arrays back through transistor Q1 into the positive terminal of battery 26, and likewise back to the positive DC output of bridge rectifier BR1, thus allowing current to flow only in the directions from the anodes of diodes D3 and D4 to the cathodes of diodes D3 and D4 respectively. The base of transistor Q1 is properly biased through resistor R3 to DC ground 66 and the cathode of diode D1 such that transistor Q1 remains off and does not conduct when DC power is present at the positive DC output of bridge rectifier BR1. When there is an absence of DC power at the positive DC output of bridge rectifier BR1 as a result of AC power failure or if power disconnect test switch 50 (SW1) is depressed, the base of transistor Q1 will cause transistor Q1 to conduct and allow the DC voltage from battery 26 to flow from the positive terminal of backup battery 26 through transistor Q1 from the emitter to the collector and through diode D3 to power red LEDs 32A and green LEDs 32B, and also to flow through diode D4 to power monochrome LEDs 48A and 48B in optional emergency light LED lights 30A and 30B.

Figure 6:
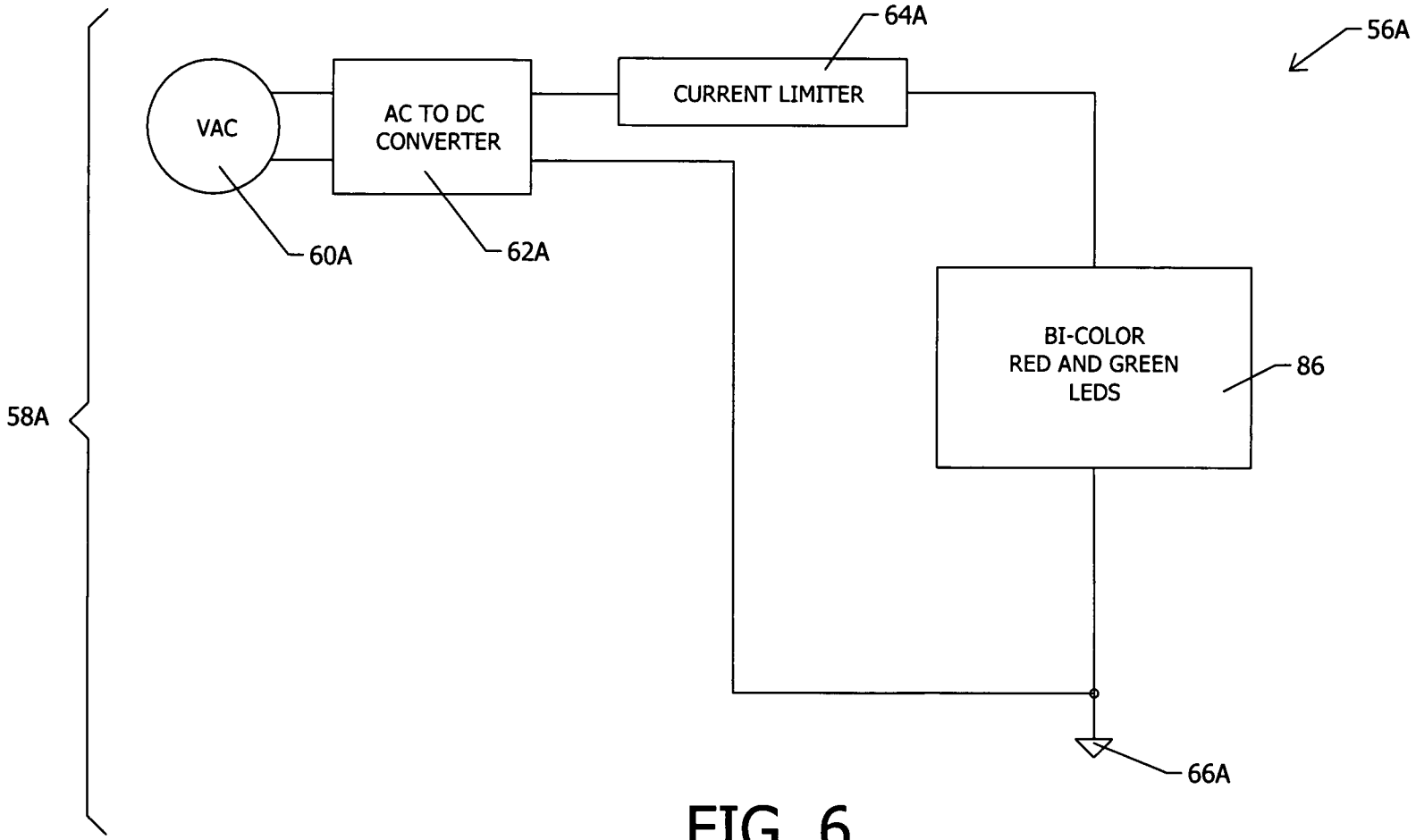
FIG. 6 is a schematic block diagram analogous to FIG. 3 that shows an alternative color LED lamp with bicolor red and green LEDs.

FIG. 6 shows a schematic block diagram 56A of a bicolor LED lamp 58A taken in isolation. Bicolor LED lamp 58A is an alternative embodiment to color LED lamp 58 shown in FIG. 3. Bicolor LED lamp 58A can be used in retrofit applications for existing illuminated signs or as the main color LED lamp in new fixtures. LED lamp 58A includes alternating current voltage (VAC) power input 60A that is converted by AC to DC converter 62A, analogous to AC/DC converter 62 shown in FIG. 3, into a direct current DC voltage output. A single main or individual current limiter, or resistor 64A, is used to limit the current going into the bicolor LED consisting of a red and a green LED die having separate anodes and sharing a common cathode. Bicolor red and green LEDs 86 are analogous to the monochrome red LEDs 32A and monochrome green LEDs 32B of color sign 10.

A current limiter, or resistor 64A, which is analogous to current resistor 64 of LED lamp 58, is in direct current communication with bicolor red and green LEDs 86. Current limiter 64A, thus limits the current to red and green bicolor LEDs 86. Bicolor LEDs 86 may comprise a plurality of bicolor LEDs 86 connected in both a series and a parallel configuration for redundancy. This is done, so that the majority of red and green bicolor LEDs 86 will remain energized in the event that one or more bicolor LEDs 86 in each array should fail. Red colors and green colors of bicolor LEDs 86 are energized at the same time. When both the red and green colors of bicolor LEDs 86 are energized, a third color, namely, the color yellow, will be produced from the additive color mixing of the output color emissions of the color red with the color green. Bicolor LEDs 86 is connected to DC ground 66A.

Color LED lamp 58A allows the use of a single or multiple bicolor LEDs, that is, a single or multiple red and green bicolor LEDs can be manufactured as an alternative to the individual and discrete red and green LEDs set forth and described herein for color LED lamp 58 shown in FIG. 3. Thus, the bicolor LEDs 86 of FIG. 6 each contain red and green LED dies that can be energized simultaneously to emit both red color and green color to produce the color yellow. The additively mixed yellow color light then passes through either a red color filter to show red color indicia, or through a green color filter to show green color indicia from the exit sign.

Figure 7:
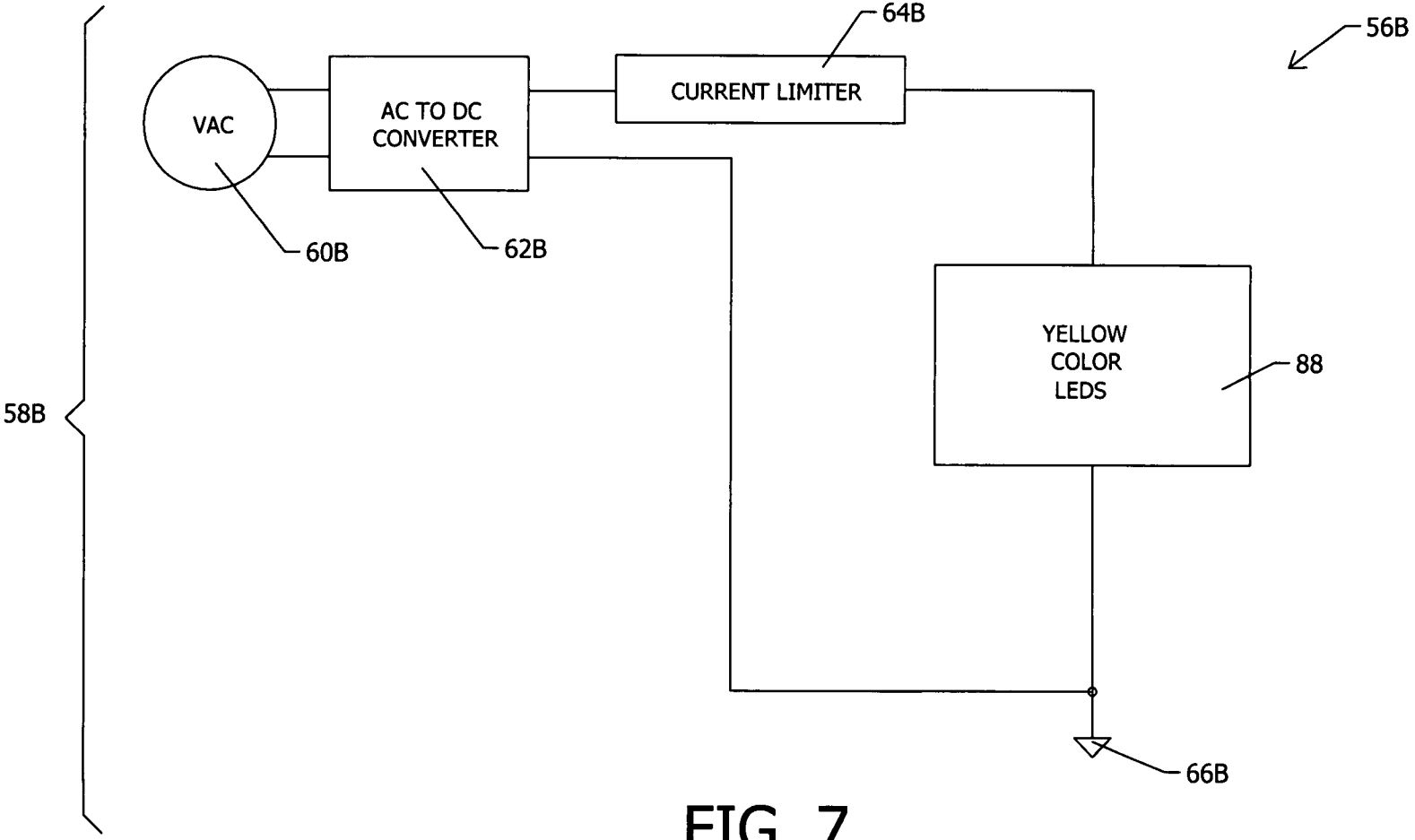
FIG. 7 is a schematic block diagram analogous to FIG. 3 that shows an alternative color LED lamp with yellow color output LEDs.

FIG. 7 shows a schematic block diagram 56B of a yellow color LED lamp 58B taken in isolation. Yellow color LED lamp 58B is an alternative embodiment to color LED lamp 58 shown in FIG. 3. Yellow color LED lamp 58B can be used in retrofit applications for existing illuminated signs or as the main color LED lamp in new fixtures. LED lamp 58B includes alternating current voltage (VAC) power input 60B that is converted by AC to DC converter 62B, analogous to AC/DC converter 62 shown in FIG. 3, into a direct current DC voltage output. A single main or individual current limiter, or resistor 64B, is used to limit the current going into the yellow color LEDs 88. Monochrome yellow color LEDs 88 are analogous to monochrome red LEDs 32A and monochrome green LEDs 32B of color sign 10.

A current limiter, or resistor 64B, which is analogous to current resistor 64 of LED lamp 58, is in direct current communication with yellow color LEDs 88. Current limiter 64B, thus limits the current to yellow color LEDs 88. Yellow color LEDs 88 may comprise a plurality yellow color LEDs 88 connected in both a series and a parallel configuration for redundancy. This is done, so that the majority of yellow color LEDs 88 will remain energized in the event that one or more yellow color LEDs 88 in each array should fail. Yellow color LEDs 88 are all energized at the same time. Yellow color LEDs 88 are connected to DC ground 66B.

The yellow color light emitted from yellow color LEDs 88 then passes through either a red color filter to show red color indicia, or through a green color filter to show green color indicia from the exit sign.

Figure 8:
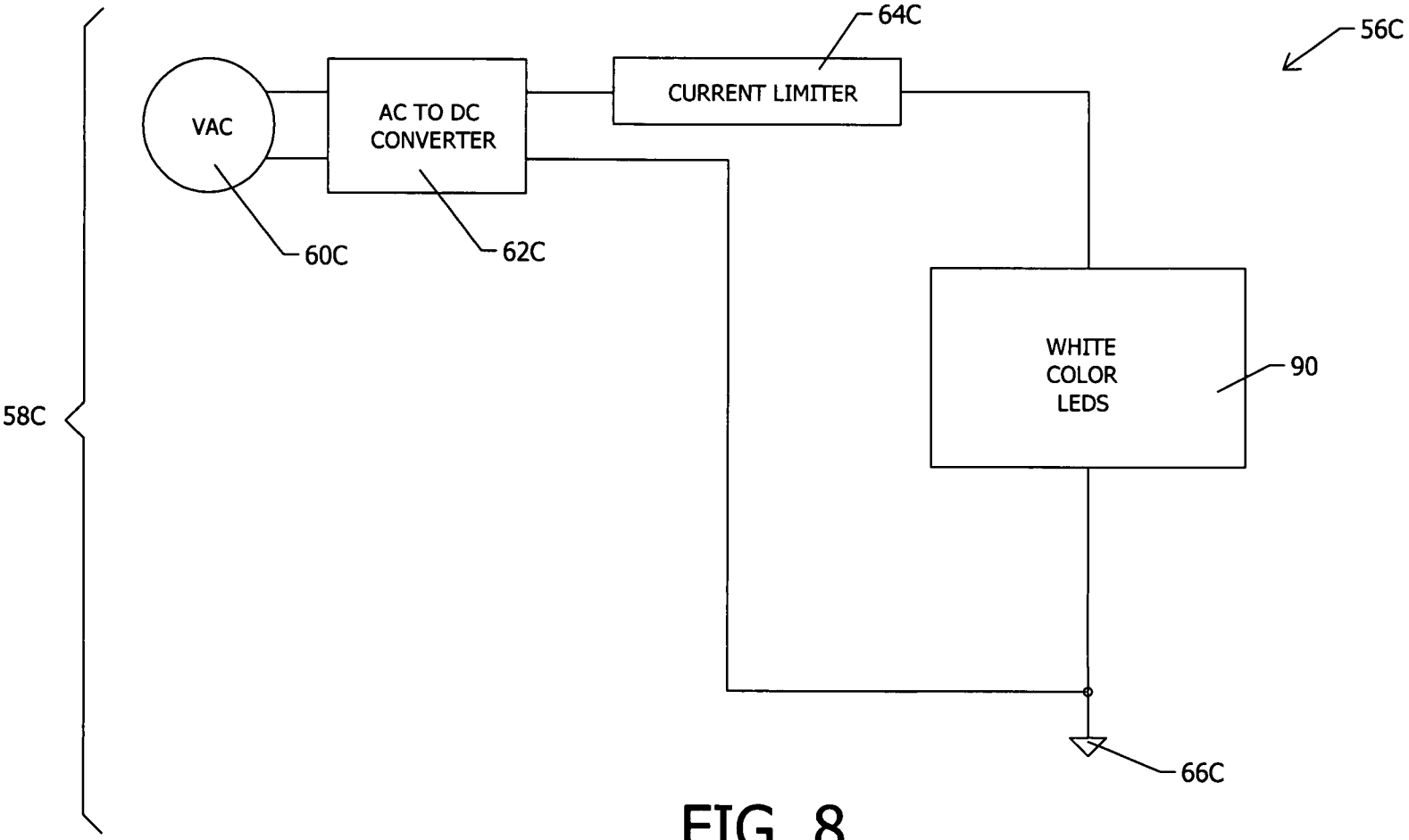
FIG. 8 is a schematic block diagram analogous to FIG. 3 that shows an alternative color LED lamp with white color output LEDs.

FIG. 8 shows a schematic block diagram 56C of a white color LED lamp 58C taken in isolation. White color LED lamp 58C is an alternative embodiment to color LED lamp 58 shown in FIG. 3. White color LED lamp 58C can be used in retrofit applications for existing illuminated signs or as the main color LED lamp in new fixtures. LED lamp 58C includes alternating current voltage (VAC) power input 60C that is converted by AC to DC converter 62C, analogous to AC/DC converter 62 shown in FIG. 3, into a direct current DC voltage output. A single main or individual current limiter, or resistor 64C, is used to limit the current going into the warm white color LEDs 90. White color LEDs 90 are analogous to the monochrome red LEDs 32A and green LEDs 32B of color sign 10.

A current limiter, or resistor 64C, which is analogous to current resistor 64 of LED lamp 58, is in direct current communication with white color LEDs 90. Current limiter 64C, thus limits the current to white color LEDs 90. White color LEDs 90 may comprise a plurality of white color LEDs 90 connected in both a series and a parallel configuration for redundancy. This is done, so that the majority of white color LEDs 90 will remain energized in the event that one or more white color LEDs 90 in each array should fail. White color LEDs 90 are all energized at the same time. White color LEDs 90 are connected to DC ground 66C. The white color then passes through either a red color filter to show red color indicia, or through a green color filter to show green color indicia from the exit sign.

The different color LED lamp embodiments presented herein show different types of color LEDs and configurations for use with either a red color filter to get a red color output indicia, or a green color filter to get a green color output indicia in the same LED exit sign using the different color output LEDs of the present invention.

At this point in the present application the exit sign hereinbefore described is set forth with the inventive features more particularly defined in another embodiment shown in new FIGS. 9 to 20. These new figures and the descriptions thereof set forth below bring forth an essential aspect of the invention indicated previously but now clearly set forth as related to new FIGS. 9 to 20.

Mention is again made to U.S. Pat. No. 7,114,840 issued to Hamrick, which has been discussed previously.

In column 6, lines 23 to 40 therein is the following disclosure: "A dipswitch 54 containing two separate switches is positioned on circuit board 35 proximate to and in electrical connection to LEDs 32. Dipswitch 54 is in electrical connection to circuitry connected to the circuit board (not shown) and LEDs 32, and is manually operable to select any one of the following options as shown in dipswitch settings table 2A as follows:

1. Deactivation of any color to selective color LED sign 10;
2. Activation of red LEDs 32A so as to produce red color as represented by red beam 42;
3. Activation of green LEDs 32B so as to produce green color as represented by green beam 46;
4. Activation of both red LEDs 32A and green LEDs 32B resulting in the emission of red and green colors that mix to produce yellow light as represented by yellow beam 44."

The added embodiment of the present invention as set forth in new FIGS. 9 to 20 together with the detailed description of each of the figures that follow herein will illustrate essential inventive characteristics.

Figure 9:
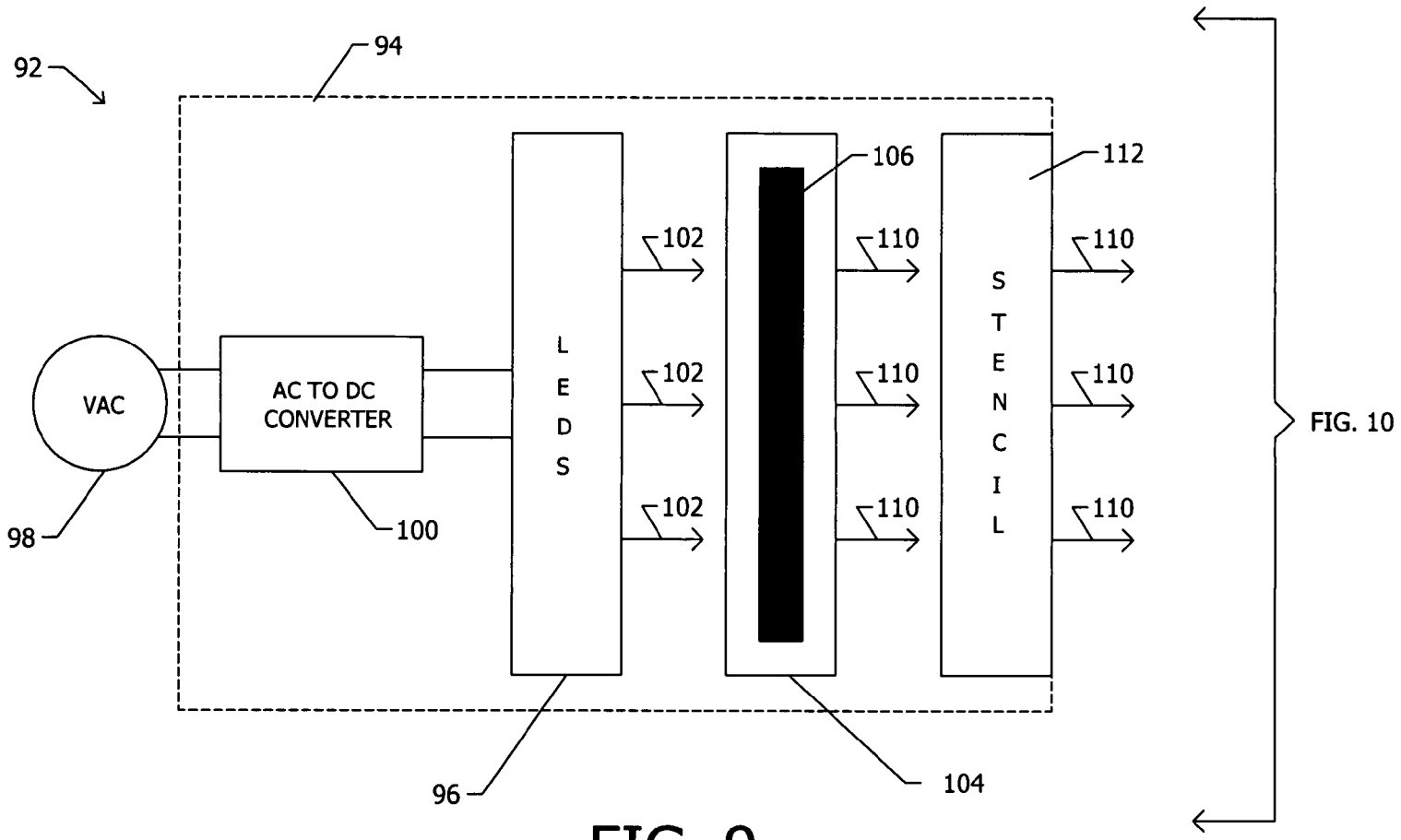
FIG. 9 is a sectional view of an embodiment of an exit sign that includes a plurality of green color LEDs and red color LEDs positioned to emit yellow color light to a sectional view of a green color filter removably positioned in a sectioned filter holder and also a stencil positioned to receive green color light for passing to an observer.

FIG. 9 shows an exit sign 92 in accordance with the present invention. Exit sign 92 includes a housing 94 shown in phantom line. An array of LEDs 96 shown in abstract rendering positioned in housing 94 is electrically connected to a source of electrical power including an alternating current voltage (VAC) 98 connected to an AC-DC converter 100. LEDs 96 include monochrome green color LEDS and monochrome red color LEDS, or in the alternative include bicolor green and red color LEDs.

FIG. 9 further shows yellow color light 102 being emitted from LEDs 96 in accordance with the laws of mixing of colors, wherein the yellow colors of light 102 in the example are a mixture of green color light and red color light from LEDs 96. A filter holder 104 shown in a sectioned mode is positioned in housing 94, so as to receive yellow color light 102. Removably positioned in filter holder 104 is a green color filter 106, wherein green color light 110 emerges from green color filter 106 and passes to a stencil 112.

Figure 10:
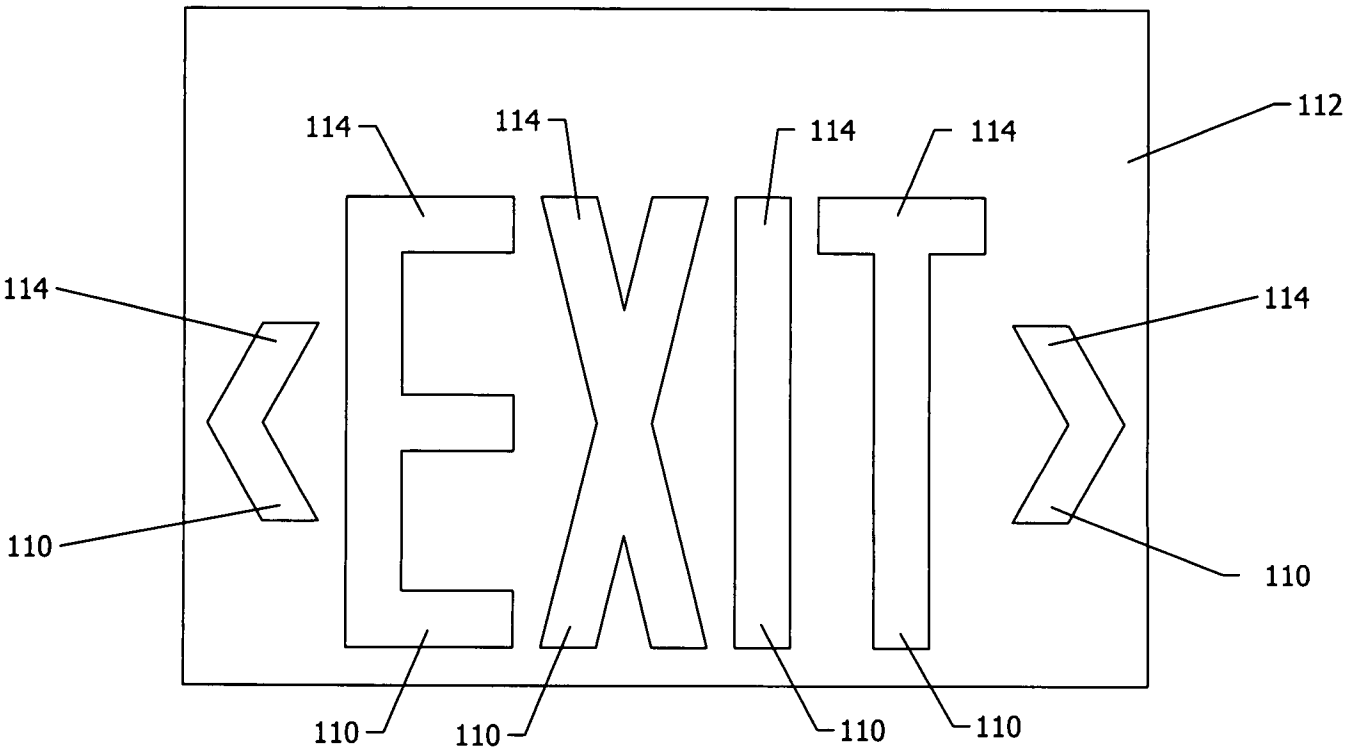
FIG. 10 is a front view of the exit sign system shown in FIG. 9 that shows the front of the stencil shown in FIG. 9 including indicia that define the word EXIT in capital letters.

As shown in FIG. 10, green color light 110 passes through openings 114 formed in stencil 112 that represent the letters EXIT for viewing by an observer. Directional arrows or other exit indicators can be provided in conjunction with or in lieu of the word EXIT.

Figure 11:
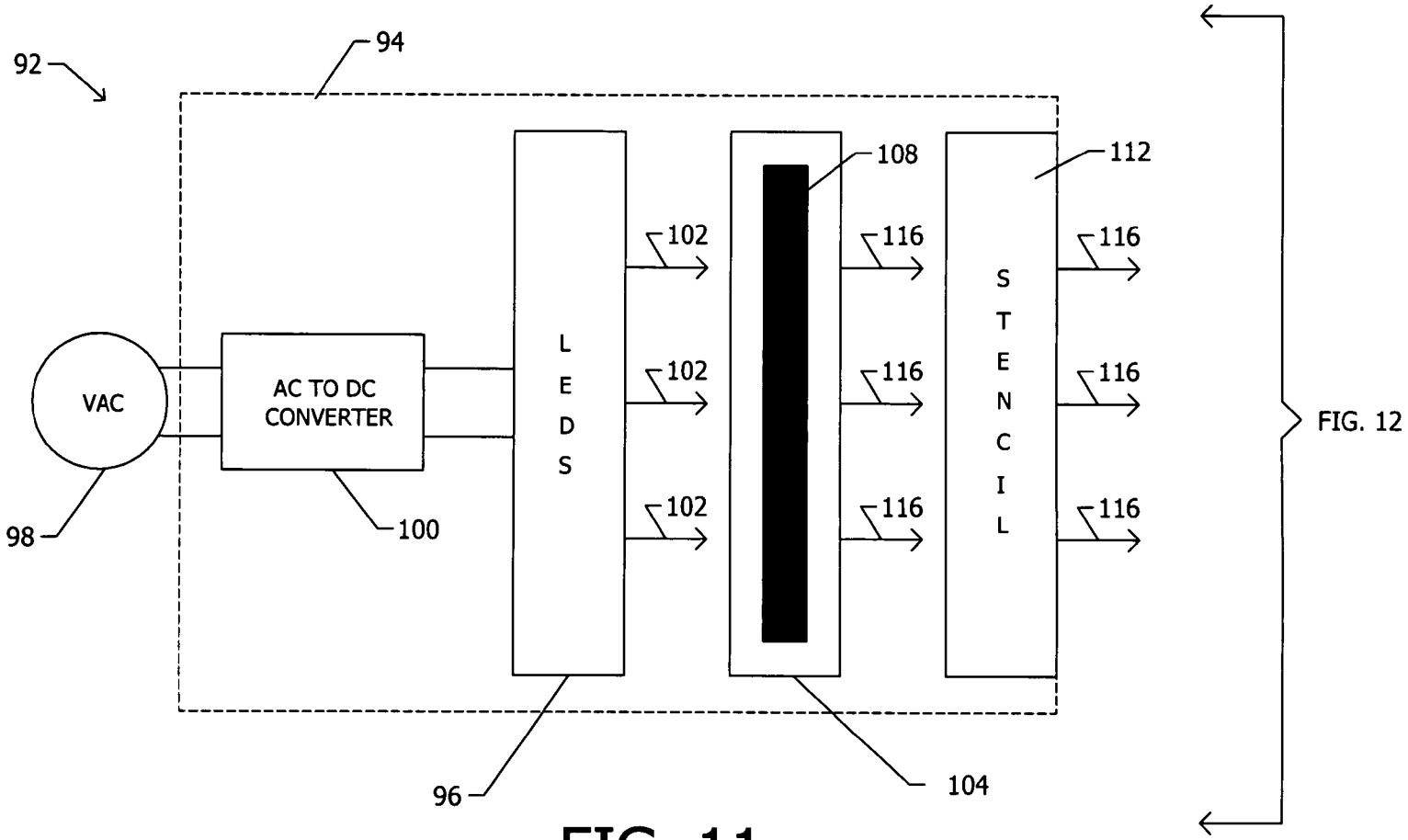
FIG. 11 is a sectional view of an embodiment of an exit sign that includes a plurality of green color LEDs and red color LEDs positioned to emit yellow color light to a sectional view of a red color filter removably positioned in a sectioned filter holder and also a stencil positioned to receive red color light for passing to an observer.

FIG. 11 shows exit sign 92 in another mode. In the same manner as shown in FIG. 9, FIG. 11 shows an array of LEDs 96 with yellow color light 102 emitting from LEDs 96. Removably positioned in filter holder 104 is a red color filter 108, wherefrom red color light 116 emerges and passes to stencil 112.

Figure 12:
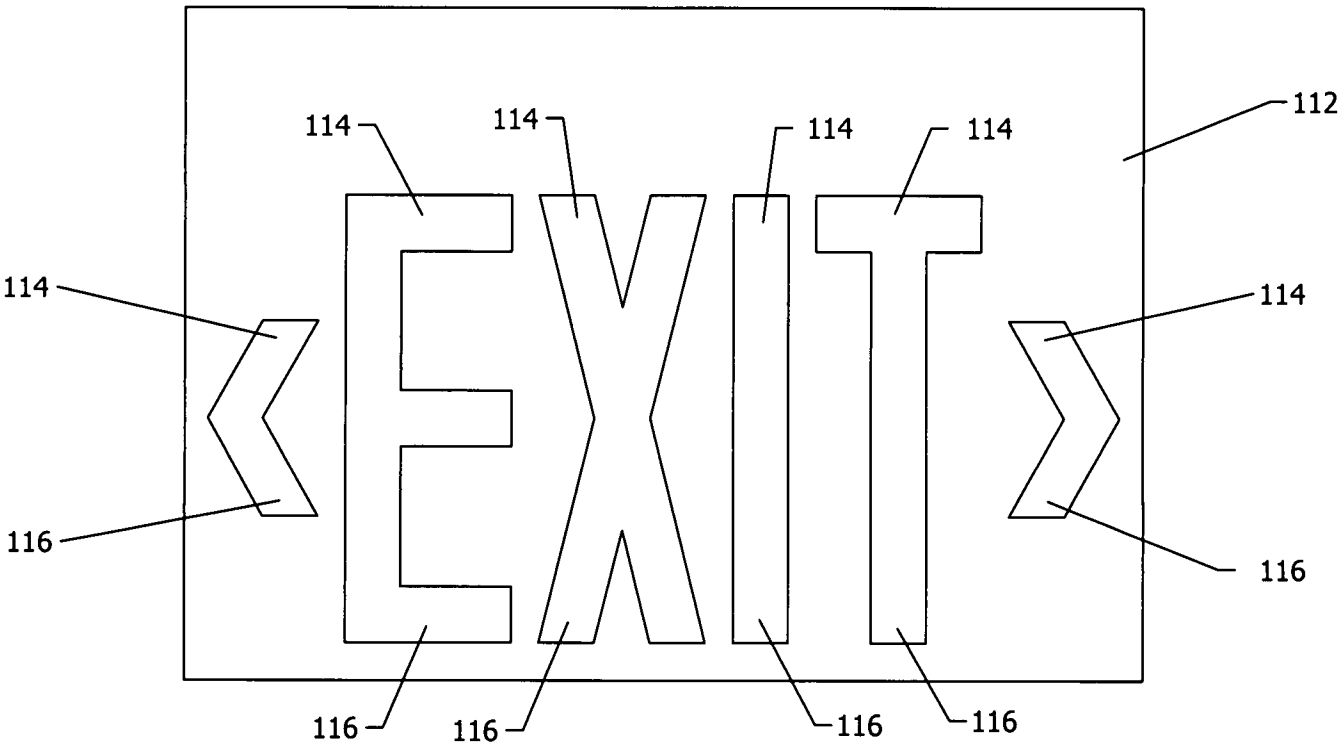
FIG. 12 is a front view of the exit sign system shown in FIG. 11 that shows the front of the stencil shown in FIG. 11 including indicia that define the word EXIT in capital letters.

In FIG. 12, red color light 116 passes through openings 114 formed in stencil 112 that represent the letters EXIT for viewing by an observer. Directional arrows or other exit indicators can be provided in conjunction with or in lieu of the word EXIT.

FIGS. 13, 14, 15 and 16 show an exit sign 118 in an embodiment similar to exit sign 92 shown in FIG. 9. Exit sign 118 includes a housing 120 shown in phantom line. An array of LEDs 122 shown in abstract rendering positioned in housing 120 is electrically connected to a source of electrical power including an alternating current voltage (VAC) 124 connected to an AC-DC converter 126. LEDs 122 include monochrome yellow color LEDS that includes wavelengths of green color light and red color light spectrums.

Figure 13:
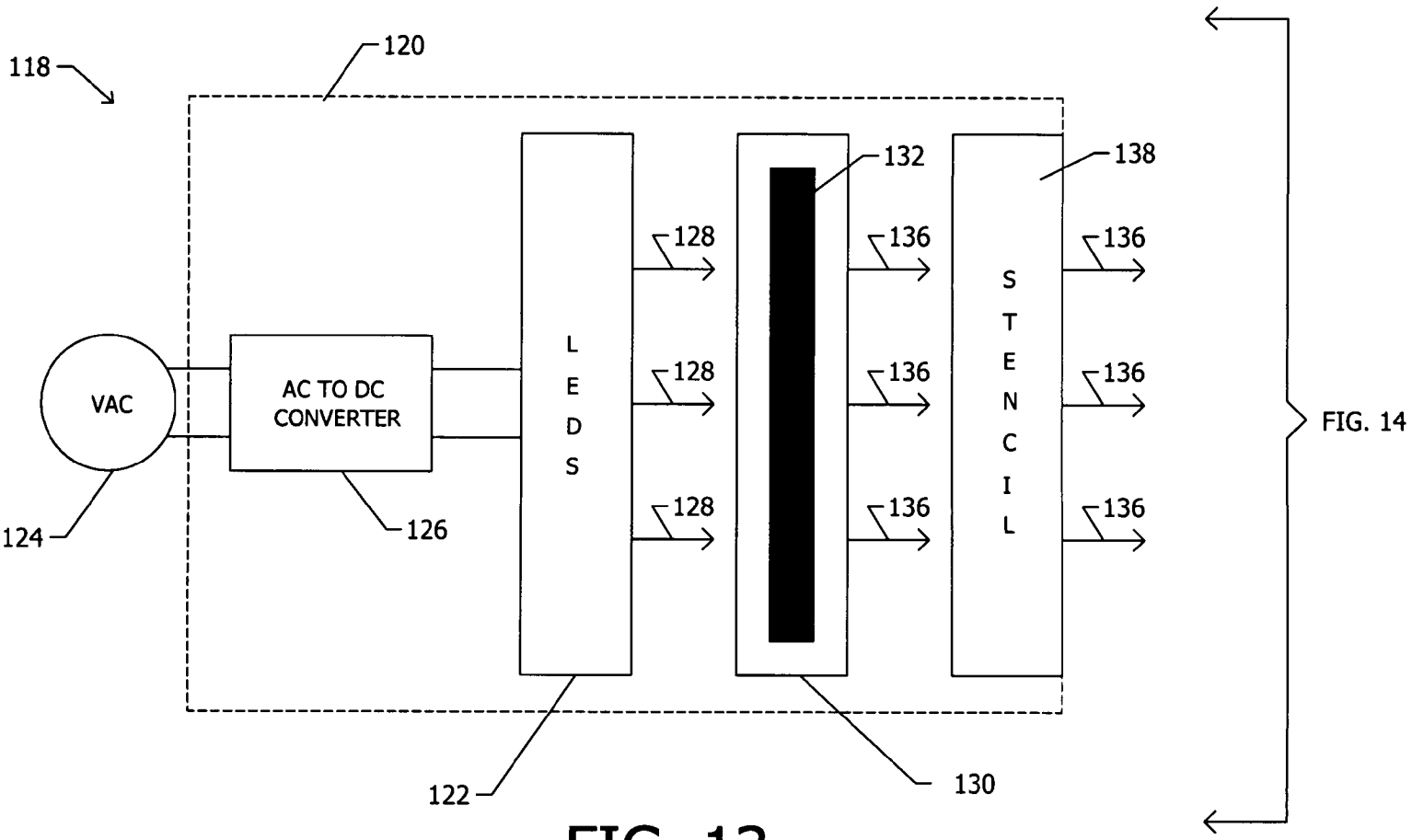
FIG. 13 is a sectional view of an embodiment of an exit sign that includes a plurality of yellow color LEDs positioned to emit yellow color light to a sectional view of a green color filter removably positioned in a sectioned filter holder and also a stencil positioned to receive green color light for passing to an observer.

FIG. 13 further shows yellow color light 128 being emitted from LEDs 122. A filter holder 130 shown in a sectioned mode is positioned in housing 120, so as to receive yellow color light 128. Removably positioned in filter holder 130 is a green color filter 132, wherein green color light 136 emerges from green color filter 132 and passes to a stencil 138.

Figure 14:
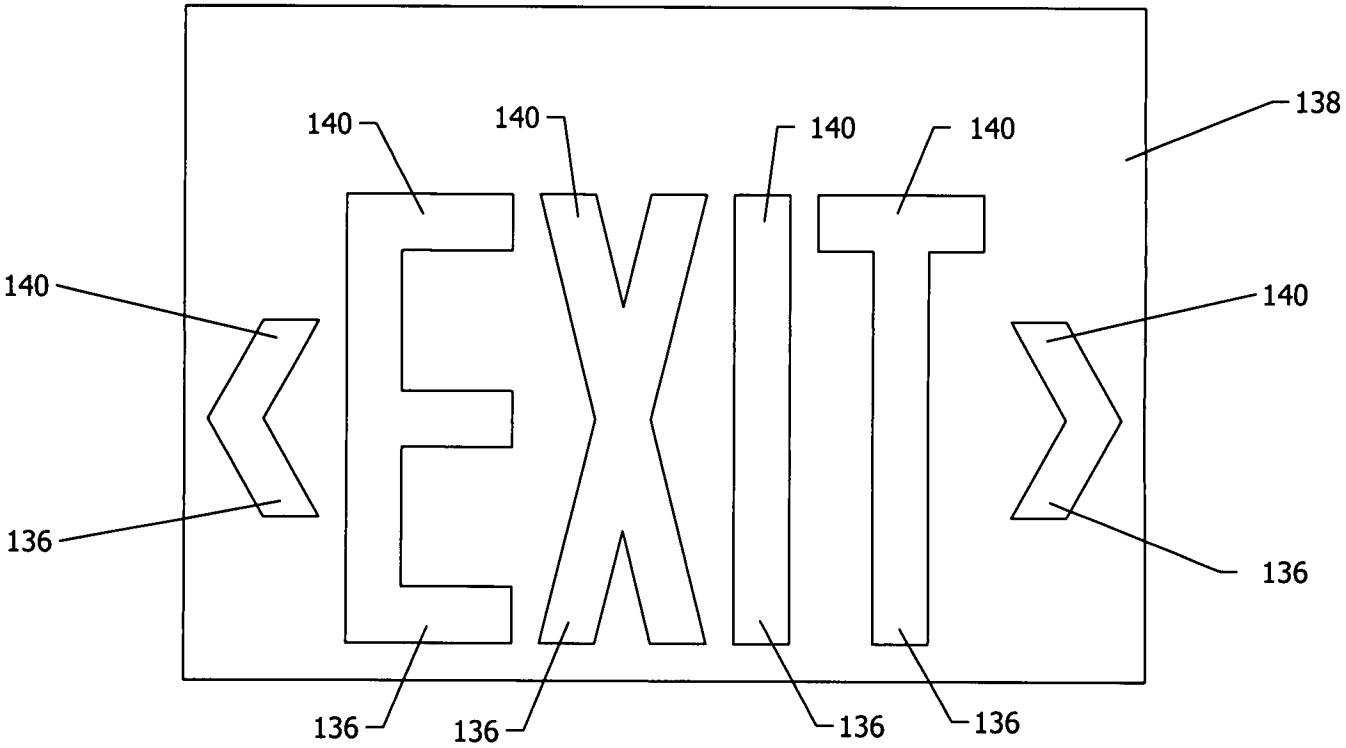
FIG. 14 is a front view of the exit sign system shown in FIG. 13 that shows the front of the stencil shown in FIG. 13 including indicia that define the word EXIT in capital letters.

As shown in FIG. 14, green color light 136 passes through openings 140 formed in stencil 138 that represent the letters EXIT for viewing by an observer. Directional arrows or other exit indicators can be provided in conjunction with or in lieu of the word EXIT.

Figure 15:
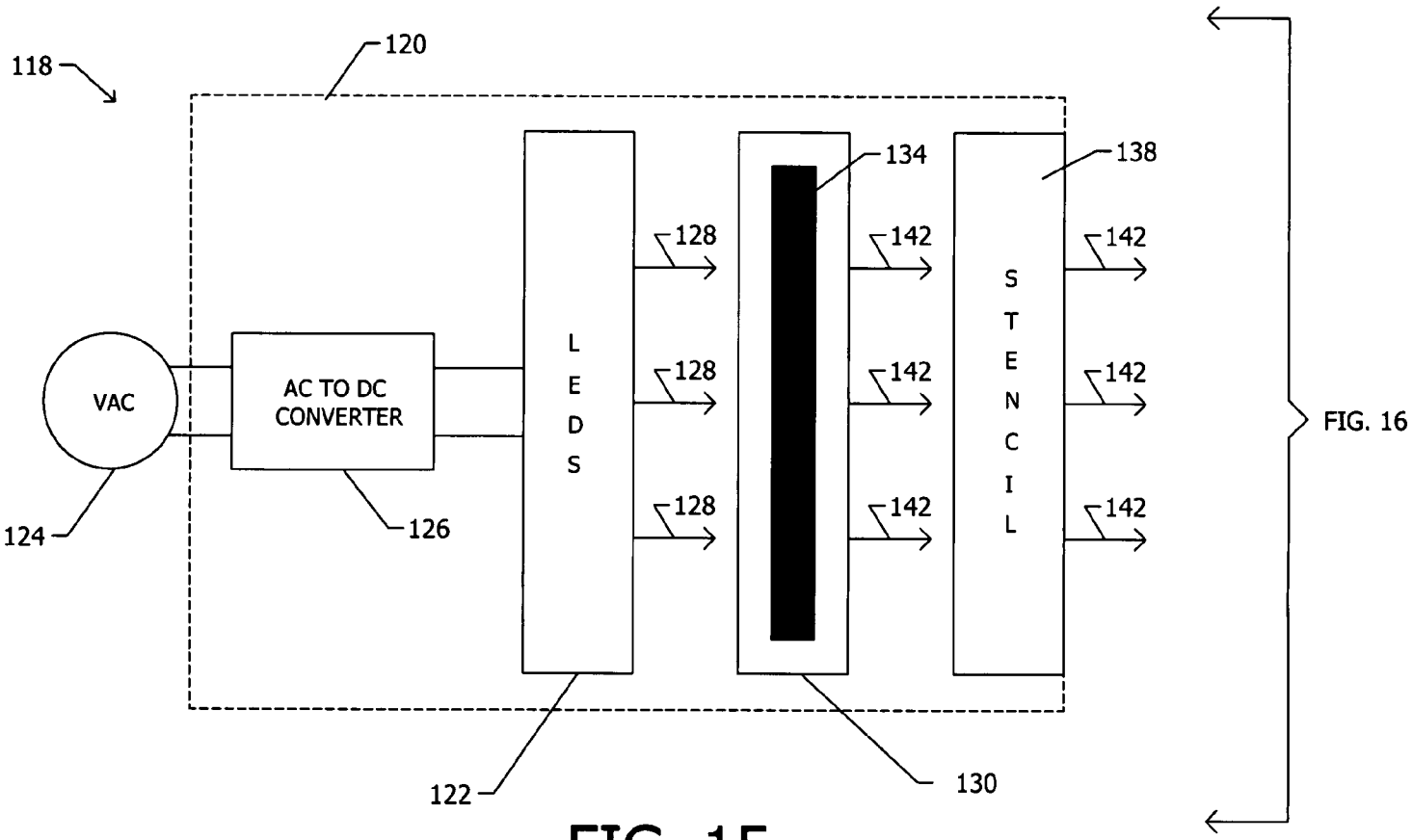
FIG. 15 is a sectional view of an embodiment of an exit sign that includes a plurality of yellow color LEDs positioned to emit yellow color light to a sectional view of a red color filter removably positioned in a sectioned filter holder and also a stencil positioned to receive red color light for passing to an observer.

FIG. 15 shows exit sign 120 in another mode. In the same manner as shown in FIG. 13, FIG. 15 shows an array of LEDs 122 with yellow color light 128 emitting from LEDs 122. Removably positioned in filter holder 130 is a red color filter 134, wherefrom red color light 142 emerges and passes to stencil 138.

Figure 16:
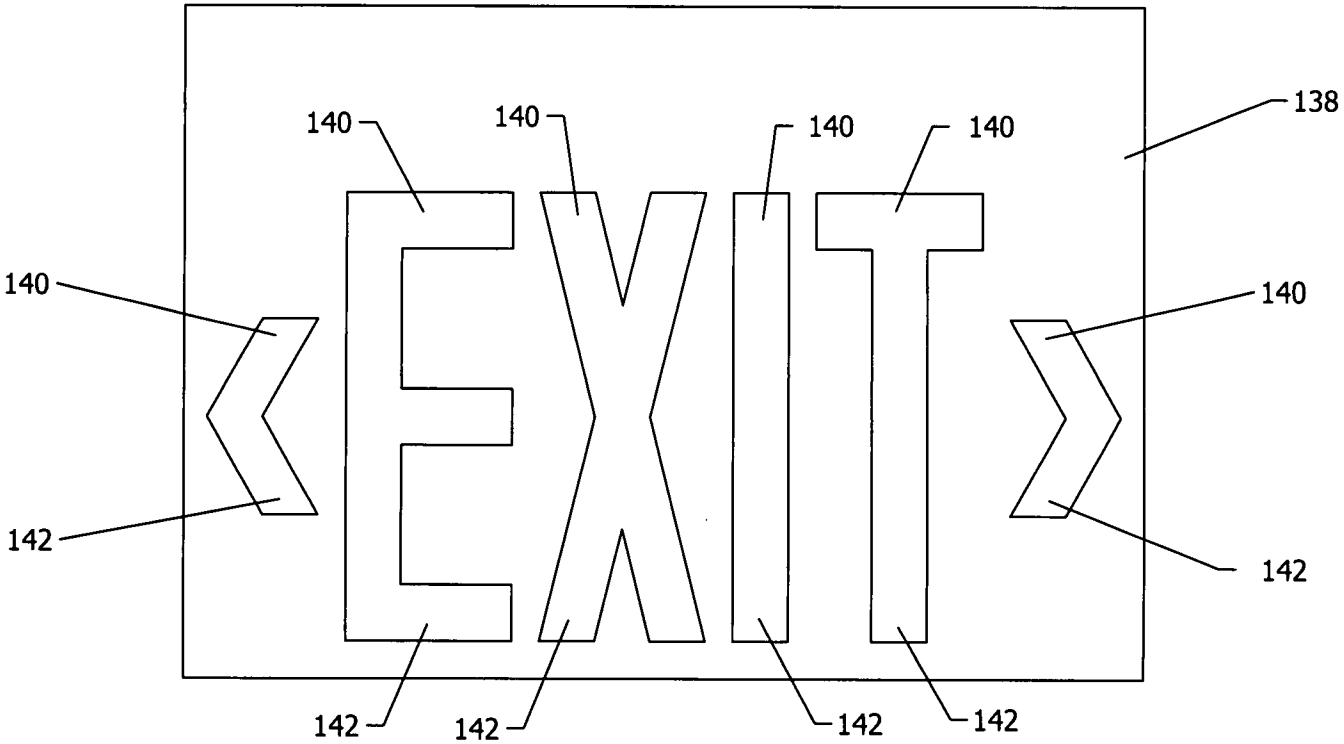
FIG. 16 is a front view of the exit sign system shown in FIG. 15 that shows the front of the stencil shown in FIG. 15 including indicia that define the word EXIT in capital letters.

In FIG. 16, red color light 142 passes through openings 140 formed in stencil 138 that represent the letters EXIT for viewing by an observer. Directional arrows or other exit indicators can be provided in conjunction with or in lieu of the word EXIT.

FIGS. 17, 18, 19 and 20 show an exit sign 144 in another embodiment similar to exit sign 92 shown in FIG. 9. Exit sign 144 includes a housing 146 shown in phantom line. An array of LEDs 148 shown in abstract rendering positioned in housing 146 is electrically connected to a source of electrical power including an alternating current voltage (VAC) 150 connected to an AC-DC converter 152. LEDs 148 include white color LEDS. White color LEDs can be cool white color LEDs, warm white color LEDs, or a combination of cool white and warm white color LEDs.

Figure 17:
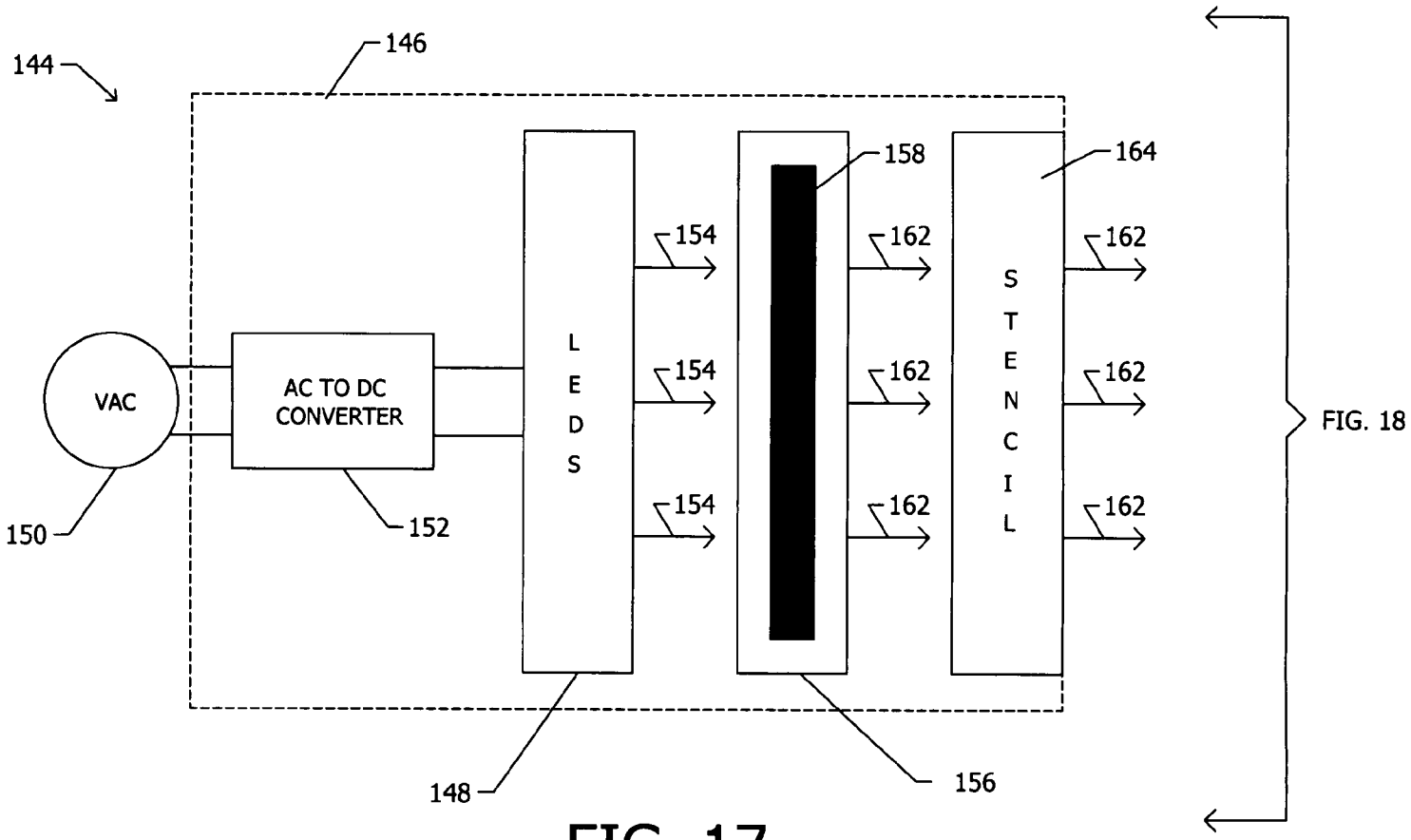
FIG. 17 is a sectional view of an embodiment of an exit sign that includes a plurality of white color LEDs positioned to emit white color light to a sectional view of a green color filter removably positioned in a sectioned filter holder and also a stencil positioned to receive green color light for passing to an observer.

FIG. 17 further shows white color light 154 being emitted from LEDs 148. A filter holder 156 shown in a sectioned mode is positioned in housing 146, so as to receive white color light 154. Removably positioned in filter holder 156 is a green color filter 158, wherein green color light 162 emerges from green color filter 158 and passes to a stencil 164. White color light 154 includes the full light spectrum including the wavelengths of green color light and red color light spectrums.

Figure 18:
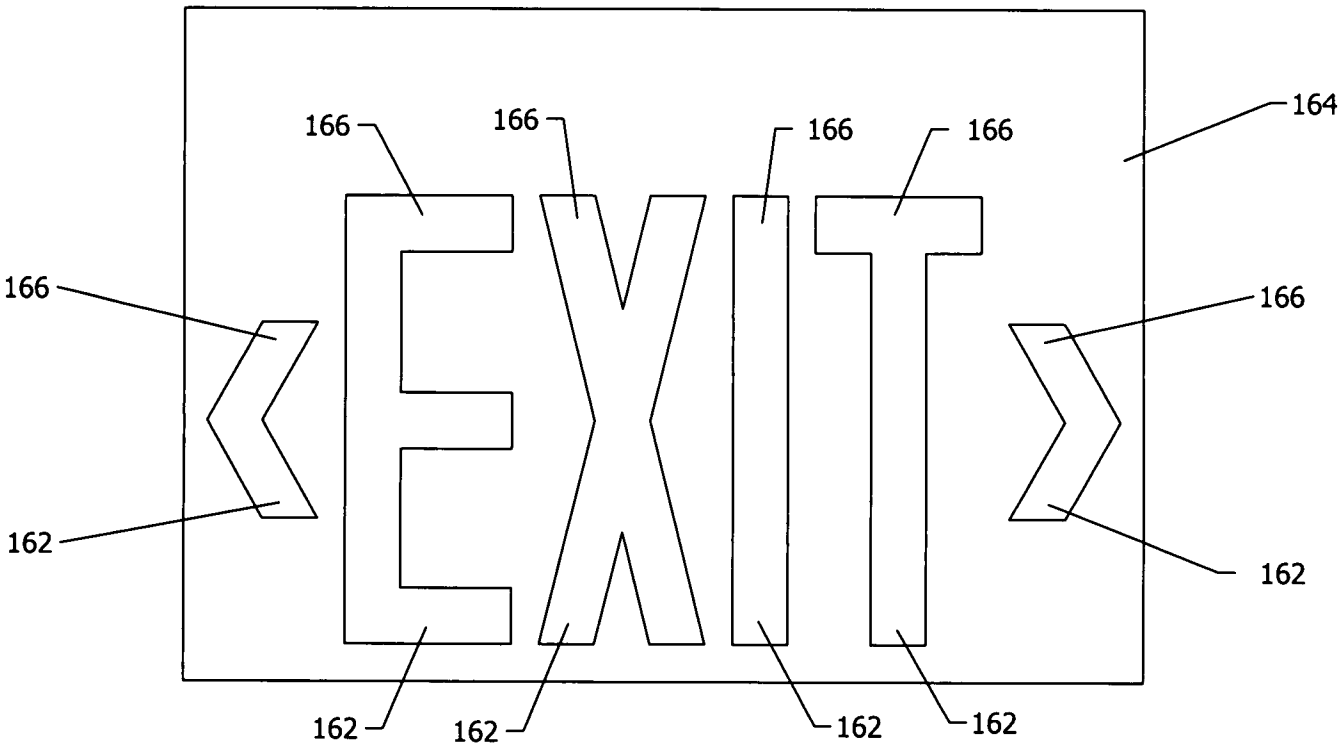
FIG. 18 is a front view of the exit sign system shown in FIG. 17 that shows the front of the stencil shown in FIG. 17 including indicia that define the word EXIT in capital letters.

As shown in FIG. 18, green color light 162 passes through openings 166 formed in stencil 164 that represent the letters EXIT for viewing by an observer. Directional arrows or other exit indicators can be provided in conjunction with or in lieu of the word EXIT.

Figure 19:
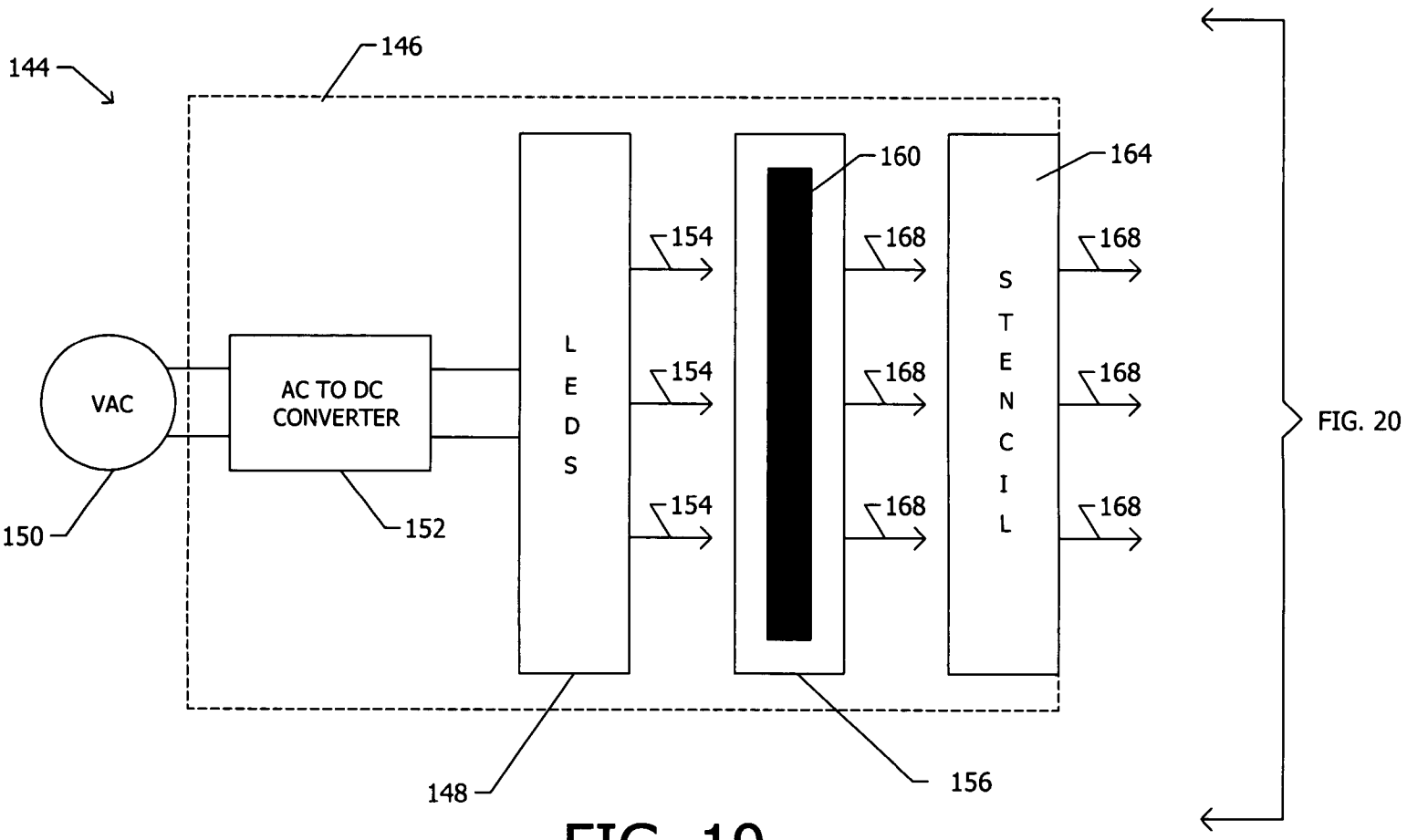
FIG. 19 is a sectional view of an embodiment of an exit sign that includes a plurality of white color LEDs positioned to emit white color light to a sectional view of a red color filter removably positioned in a sectioned filter holder and also a stencil positioned to receive red color light for passing to an observer.

FIG. 19 shows exit sign 146 in another mode. In the same manner as shown in FIG. 17, FIG. 19 shows an array of LEDs 148 with white color light 154 emitting from LEDs 148. Removably positioned in filter holder 156 is a red color filter 160, wherefrom red color light 168 emerges and passes to stencil 164.

Figure 20:
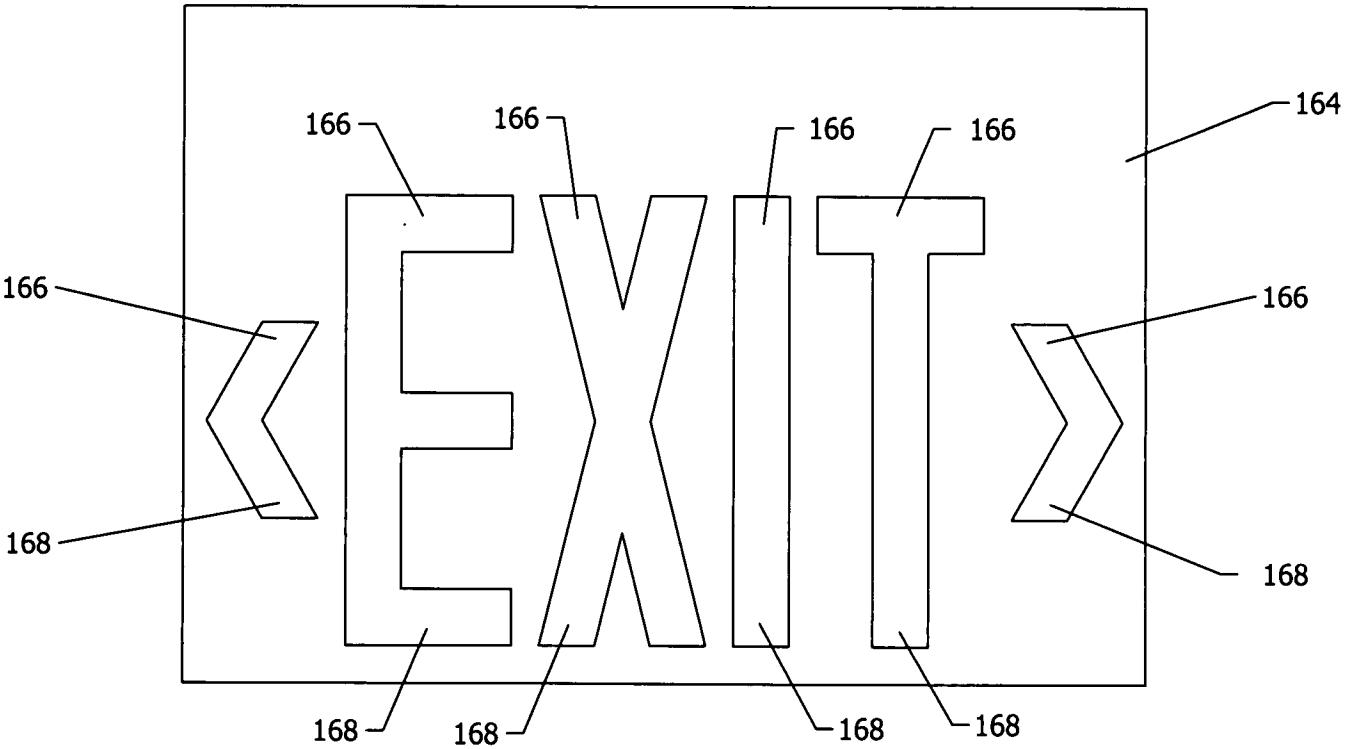
FIG. 20 is a front view of the exit sign system shown in FIG. 19 that shows the front of the stencil shown in FIG. 19 including indicia that define the word EXIT in capital letters.

In FIG. 20, red color light 168 passes through openings 166 formed in stencil 164 that represent the letters EXIT for viewing by an observer. Directional arrows or other exit indicators can be provided in conjunction with or in lieu of the word EXIT.

Exit sign 92 or 118 or 144 is shipped by the supplier to the installation site with both a green color filter and a red color filter. The site installer of exit sign 92 or 118 or 144 selects the color filters required by local law whatever the case might be whether green or red, which are the standard exit sign colors, and inserts the selected filter whether green color or red color into filter holder 104 or 130 or 156. For double face exit signs, there will be up to two filter holders in each exit sign that will each accept a green color filter or a red color filter.

Green color filter 106 or 132 or 158 and red color filter 108 or 134 or 160 are clear color filters. A diffuser (not shown) can be used in combination with a clear color filter as described in the earlier sections of the present application. In the alternative, a color filter can be combined with a diffuser wherein the green color filter and red color filter will be a green color diffusion filter and a red color diffusion filter, respectively as is known in the art.

Filter holder 104 or 130 or 156 and stencil 112 or 138 or 164 are separate and distinct components as described in the earlier sections of the present application. In the alternative, a stencil can serve as a filter holder, wherein the stencil is also a filter holder. For double face exit signs, there will be up to two stencils and/or up to two filter holders in each exit sign.

A battery can provide power for emergency light as described earlier in this application.

It will be understood that various changes in the details, materials, types, values, and arrangements of the components that have been described and illustrated in order to explain the nature of this invention may be made by those skilled in the art without departing from the principle and scope of the invention as expressed in the following claims.

What is claimed is:

1. An exit sign comprising:

a housing, a plurality of green color LEDs and red color LEDs positioned in said housing for concurrently emitting both green color light and red color light, wherein the plurality of green color LEDs are in an alternating arrangement with the red color LEDs, at least one filter holder positioned in said housing for holding one of a selected green color filter and a selected red color filter such that one of a green color light and a red color light, respectively, can pass through said one of a selected green color filter and a selected red color filter from the plurality of green color LEDs and red color LEDs, at least one stencil defining openings that form a symbol indicating a route of egress viewable by an observer, wherein said at least one stencil is juxtaposed to the at least one filter holder such that said one of a green color light and a red color light can pass through said at least one stencil, DC circuitry in a permanent operative connection with all of the plurality of green color LEDs and red color LEDs such that all of the plurality of green color LEDs and red color LEDs can be energized at a same time, and an AC converter for converting a source of AC electrical power to provide DC power to said DC circuitry.

2. The exit sign according to claim 1, wherein said green color LEDs and said red color LEDs are monochrome green color LEDs and monochrome red color LEDs.

3. The exit sign according to claim 1, further including at least one light diffuser.

4. The exit sign according to claim 1, wherein said one of a selected green color filter and a selected red color filter includes at least one light diffuser.

5. The exit sign according to claim 1, wherein said at least one stencil is said at least one filter holder.

6. The exit sign according to claim 1, wherein said symbol is the word EXIT.

7. The exit sign according to claim 6, wherein said symbol further includes a directional arrow.

8. An exit sign comprising:

a housing, a plurality of bicolor green and red color LEDs positioned in said housing for emitting yellow color light, at least one filter holder positioned in said housing for holding one of a selected green color filter and a selected red color filter such that one of a green color light and a red color light, respectively, can pass through said one of a selected green color filter and a selected red color filter from the plurality of bicolor green and red color LEDs, at least one stencil defining openings that form a symbol indicating a route of egress viewable by an observer, wherein said at least one stencil is juxtaposed to the at least one filter holder such that said one of a green color light and a red color light can pass through said at least one stencil, DC circuitry in a permanent operative connection with all of the plurality of bicolor green and red color LEDs such that all of the plurality of bicolor green and red color LEDs can be energized at a same time, and an AC converter for converting a source of AC electrical power to provide DC power to said DC circuitry.

9. The exit sign according to claim 8, wherein said bicolor green and red color LEDs are monochrome yellow color LEDs.

10. The exit sign according to claim 8, further including at least one light diffuser.

11. The exit sign according to claim 8, wherein said one of a selected green color filter and a selected red color filter includes at least one light diffuser.

12. The exit sign according to claim 8, wherein said at least one stencil is said at least one filter holder.

13. The exit sign according to claim 8, wherein said symbol is the word EXIT.

14. The exit sign according to claim 13, wherein said symbol further includes a directional arrow.

15. The exit sign according to claim 1, wherein the DC circuitry is a current limiter connected to the plurality of green color LEDs and red color LEDs.

16. The exit sign according to claim 15, wherein the AC converter is connected to the current limiter through a switching circuit.

17. The exit sign according to claim 16, wherein the switching circuit is connected to a rechargeable battery.

18. The exit sign according to claim 1, wherein the plurality of green color LEDs and red color LEDs are connected in parallel.

19. The exit sign according to claim 1, wherein the plurality of green color LEDs and red color LEDs are connected in series.

20. The exit sign according to claim 8, wherein the DC circuitry is a current limiter connected to the plurality of bicolor green and red color LEDs.

21. The exit sign according to claim 20, wherein the AC converter is connected to the current limiter through a switching circuit.

22. The exit sign according to claim 21, wherein the switching circuit is connected to a rechargeable battery.

* * * * *